United States Patent [19]

Yoshida et al.

[11] Patent Number: 4,826,758

[45] Date of Patent: May 2, 1989

[54] SILVER HALIDE EMULSION AND PROCESS FOR PREPARING IT, AND LIGHT-SENSITIVE HALIDE PHOTOGRAPHIC MATERIAL EMPLOYING SAID SILVER HALIDE EMULSION

[75] Inventors: Eiji Yoshida; Akio Suzuki; Masumi Hosaka, all of Hino, Japan

[73] Assignee: Konishiroku Photo Industry Co., Ltd., Tokyo, Japan

[21] Appl. No.: 36,889

[22] Filed: Apr. 10, 1987

[30] Foreign Application Priority Data

Apr. 19, 1986 [JP] Japan ..... 61-91133

[51] Int. Cl.[4] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 2,628,167 | 2/1953 | Witt et al. | 430/608 |
| 3,445,235 | 5/1969 | Burt | 430/608 |
| 3,655,390 | 4/1972 | Overman | 430/569 |
| 3,772,032 | 11/1973 | Pearson et al. | 430/628 |
| 4,477,564 | 10/1984 | Cellone et al. | 430/569 |
| 4,497,895 | 2/1985 | Matsuzaka et al. | 430/569 |
| 4,533,627 | 8/1985 | Yates et al. | 430/569 |
| 4,539,290 | 9/1985 | Munaw | 430/569 |
| 4,614,711 | 9/1986 | Sugimoto et al. | 430/567 |

*Primary Examiner*—Mukund J. Shah

*Attorney, Agent, or Firm*—Jordan B. Bierman

[57] ABSTRACT

A light-sensitive silver halide photographic emulsion wherein the silver halide crystals thereof are formed by:

preparing a dispersion containing homogeneously dispersed silver halide particles, the particles containing silver iodide and having an average grain size of 0.5 μm or less, adding an aqueous solution containing at least one halide other than iodide, and an aqueous solution containing a silver salt, to the dispersion, thereby effecting growth, and adding an aqueous solution containing iodide during the course of the crystal growth, independent of the addition of the solution containing the halide other than iodide.

31 Claims, No Drawings

SILVER HALIDE EMULSION AND PROCESS FOR PREPARING IT, AND LIGHT-SENSITIVE HALIDE PHOTOGRAPHIC MATERIAL EMPLOYING SAID SILVER HALIDE EMULSION

FIELD OF THE INVENTION

The present invention relates to a silver halide emulsion and a process for preparing it, and a light-sensitive silver halide photographic material employing said silver halide emulsion. Particularly, it provides a light-sensitive material having high sensitivity and excellent pressure resistance, and an emulsion for, and a preparation process for, obtaining the same.

BACKGROUND OF THE INVENTION

It is desired for light-sensitive photographic materials to have high sensitivity and to be easy to handle. In particular, with the recent progress of various photographic techniques, there are demands for more higher sensitivity in the respective fields. For example, there are demands for higher speed shuttering in cameras, demands for speedier processing in processing techniques for color and black-and-white films or photographic papers, demands for employment of electronics and for simplification in printing industries or the like, demands for improvements of various diagnostic abilities by X-ray photography and for lessened irradiation dose of X-rays in medical fields, and so on, and thus it is needed to make higher the sensitivity in complience with these demands in the respective fields. Also, in light-sensitive silver halide photographic materials, it is desired to lessen as much as possible the amount of silver to be used, from a viewpoint of the cost reduction or the resource saving, and it is needed also in this respect to make higher the sensitivity. With increase in the sensitivity, the less amount of silver can be used, whereby it becomes possible to save silver.

On the other hand, the light-sensitive photographic materials are often used in the shape of a film, using a synthetic resin as a support, and therefore sometimes tend to be folded for any reasons to cause the blackening of images after development, or cause the desensitization. Thus, as images after development may have been damaged, it must be prevented as far as possible that pressure is applied before development processing to produce the blackening at the portion to which the pressure has been applied (i.e., pressure marks), or that the desensitization takes place (i.e., pressure desensitization). Particularly in recent years, there have been made progress in various kinds of automization (for example, automatic driving systems, or automatic loading system of cameras, etc.), and therefore there is a great possibility that mechanical pressure is applied to the light-sensitive material before the development to cause the deterioration of the images. Also, in the case of X-ray films for medical use, the film size is so large that the so-called knick-mark which may occur when a film is folded during handling, thereby causing the pressure marks or the pressure desensitization. Since photographs for medical use serve as the bases of diagnoses and also judgement is made based on a delicate image appeared, the deterioration of images like this must be prevented.

However, this problem becomes much greater if the sensitivity is being made higher in complience with the demands as mentioned above. This is because the pressure marks or the pressure desensitization may become liable to occur as the sensitivity is made higher. Accordingly, in the resent state in the art, what is sought after is a light-sensitive photographic material having high sensitivity and yet being free from any pressure marks or pressure desensitization. However, it is considerably difficult to satisfy these both needs. Although many attempts to make higher the sensitivity have been made or various techniques for increasing the pressure resistance have been proposed, there has not been known any technique that can sufficiently satisfy both of these.

For example, the techniques for decreasing the pressure desensitization are disclosed in U.S. Pat. Nos. 3,655,390 and 3,772,032, and British Pat. No. 1,307,373. These techniques, however, tend to give influence to the sensitivity or the fog. Other than these, there are techniques disclosed in U.S. Pat. Nos. 3,655,390, 3,445,235 and 2,628,167, which, however, involve similar problems of desensitization or the like.

For another example, materials having excellent pressure resistance can be obtained according to the technique disclosed in Japanese Patent Examined Publication No. 48747/1985, which, however, may worsen the pressure blackening (fog) if the content of silver iodide (i.e., the content of AgI at the initial stage of a reaction system) is increased for the purpose of making the sensitivity higher.

Thus, no satisfactory light-sensitive materials have been available in the prior arts.

SUMMARY OF THE INVENTION

An object of the present invention is to provide a light-sensitive silver halide photographic material having high sensitivity and also suffering less pressure marks or pressure desensitization, and a silver halide emulsion that can give such a light-sensitive material and a process for preparing the same.

The above object of the present invention can be achieved by a technique comprising effecting crystal growth by adding a water soluble halide and a water soluble silver salt in a dispersion medium in which a silver halide containing silver iodide having an average grain size of 0.5 μm or less has been homogeneously dispersed, and allowing crystals to grow by independently adding a water soluble iodide in the course of said crystal growth.

DETAILED DESCRIPTION OF THE INVENTION

Employment of an emulsion obtained by adding a water soluble iodide in the course of the crystal growth as in the present invention can give a light-sensitive material having high sensitivity, without worsening the pressure blackening.

In the present invention, the position of addition of the water soluble iodide, in other words, the point of time in the course of crystal growth at which the water soluble iodide is added, may be arbitrarily decided, and light-sensitive materials having different performance of pressure desensitization can be obtained by selecting the position of addition.

According to the present invention, an advantage is seen in that it can achieve higher sensitivity and pressure resistance than the prior arts, for example, the technique disclosed in Japanese Patent Examined Publication No. 48747/1985 or Japanese Patent Publication Open to Public Inspection (hereinafter referred to as Japanese Patent O.P.I. Publication) No. 35726/1985 can do.

The silver halide in the emulsion obtained by the present invention may include a silver halide comprising silver iodide. The silver halide comprising the silver iodide at least may include, for example, silver iodide, silver iodobromide, silver chloroiodobromide, etc., and preferably include silver iodide.

There is no particular limitation in the content of silver iodide in the silver halide, and it may be satisfactory if the silver iodide is contained. However, the content of silver iodide is preferably 0.5 to 45 mole %, more preferably 1 to 10 mole %.

In preparing the silver halide emulsion of the present invention, the silver halide is homogeneously dispersed in a dispersion medium, and, although there is no particular limitation in the dispersion medium used here, a gelatin solution, for example, can be preferably used. Additives for changing crystal habits of crystals or additives for promoting or suppressing the crystal growth may be added in the medium.

In the present invention, a water soluble halide and a water soluble silver salt are added in the dispersion medium in which the above silver halide has been homogeneously dispersed. As the water soluble halide, there can be used any of various kinds, including, for example, bromides such as potassium bromide, sodium bromide and ammonium bromide; chlorides such as potassium chloride, sodium chloride and ammonium chloride; iodides such as potassium iodide, sodium iodide and ammonium iodide. As the water soluble silver salt, there can be also used any of various kinds, including, for example, water soluble silver nitrate, ammoniacal silver nitrate, etc.

The crystal growth may be effected preferably in an environment of not less than pH 7, more preferably not less than pH 8 and not more than pH 11. Also, the pAg may preferably range between 9.5 and 11.5.

In the present invention, the water soluble iodide is independently added in the course of the crystal growth.

The water soluble iodide may be added at any position if it is done in the course of the crystal growth. It may be added in the period during which both of the above water soluble halide and water soluble silver salt are added or in the period during which any one of them is added.

Meanwhile, mixing of the water soluble halide and the water soluble silver salt may be carried out by the simultaneous mixing, or either one of mixing time may be longer. Preferably, it is better for the mixing time of the water soluble silver salt to be longer.

The crystal growth may be effected at a temperature of 40° C. or higher, particularly preferably at a temperature ranging between 50° C. and 60° C.

In the present invention, to "independently" add the water soluble iodide means to add the water soluble iodide in a reaction system through a different route from the water soluble halide and the water soluble silver salt.

As the water soluble iodide, any of water soluble iodide can be used, and, for example, potassium iodide, sodium iodide, ammonium iodide, etc. can be used.

The iodide may be added preferably in an amount of 0.001 to 40 mole %, particularly preferably 0.01 to 5 mole %, of iodide ion, based on the silver halide at the time of the termination of the crystal growth.

The position of addition may be arbitrarily selected if it is in the course of the crystal growth as mentioned above. However, it is particularly preferable to initiate simultaneous mixing of the water soluble halide and the water soluble silver salt and add the iodide in the period starting from two minutes after the initiation of the mixing and ending with the termination of the mixing of water soluble silver halides.

During the above crystal growth, or at the time of the termination of the growth, an iridium salt may be added. As the iridium salt, $K_2[IrCl_6]$, $K_2[IrCl_6]$, etc. can be used, for example. When the iridium salt is added, it may be added preferably in an amount of $1.0\times10^{-10}$ to $1.0\times10^{-6}$ mole, particularly preferably $1.4\times10^{-7}$ to $4\times10^{-8}$ mole, per 1 mole of silver halide.

When working the present invention, a wetting agent can be used. There is no particular limitation in the wetting agent, and suitable one can be used. Preferably, however, it is a polyhydric alcohol having two or more hydroxyl groups.

When working the present invention, a restrainer can be used. As the restrainer, there can be suitably used the compounds represented by General Formula (Q) shown below.

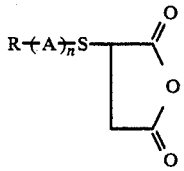

General Formula (Q)

In the formula, R represents an aliphatic group, an aromatic group or a heterocyclic residual group, each of which may have a substituent; n represents an integer of 0 or 1; and A represents —CO— or —$SO_2$—.

The aliphatic group represented by the above R may include an alkyl group having 1 to 18 carbon atoms (for example, a methyl group, a n-butyl group, an i-propyl group, a t-butyl group, and a n-dodecyl group), an alkenyl group (for example, an allyl group, a butynyl group, and an octenyl group), and a cycloalkyl group (for example, a cyclopentyl group, and a cyclohexyl group). The aliphatic group may include an aliphatic group having one or more of substituent(s) (including a substituent atom, having the same meaning hereinafter). These substituents may typically include an alkoxy group, an aryl group, an aryloxy group, an amino group, a dialkylamino group, a heterocyclic ring (for example, a N-morpholino group, a N-piperidino group), a halogen atom, a nitro group, a hydroxyl group, a carboxyl group, a sulfo group, an alkoxycarbonyl group, etc.

The aromatic group represented by R in the above may preferably include a phenyl group and a naphthyl group. The aromatic group may include an aromatic group having one or more of substituent(s). These substituents may typically include an alkyl group, an alkoxy group, a hydroxyl group, a halogen atom, an acylamino group, an alkoxycarbonyl group, a succinimide group, a carbamoyl group, a nitro group, etc.

Also, the heterocyclic residual group represented by R may preferably include a 5-membered or 6-membered heterocyclic residual group having at least one of a nitrogen atom, an oxygen atom and a sulfur atom (for example, a pyrolyl group, a pyrolydinyl group, a pyridyl group, a thiazolyl group, a morpholino group, a furanyl group, etc.). This heterocyclic residual group may have a substituent(s), and these substituents can be arbitrarily selected from the substituents for the above aliphatic group and aromatic group.
Typical examples of the restrainer represented by General Formula (Q) are shown below:
(1)
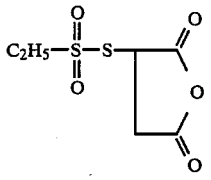
(2)
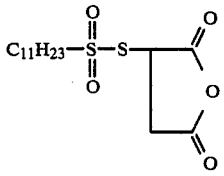
(3)
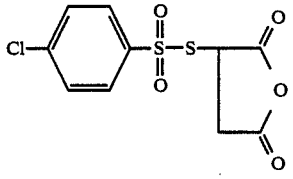
(4)
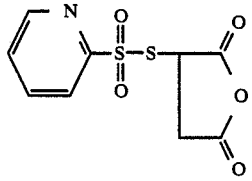
(5)
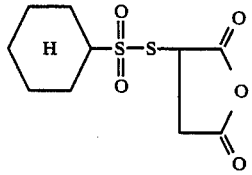
(6)
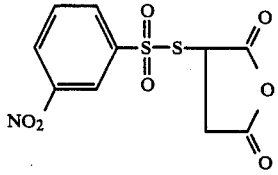
(7)
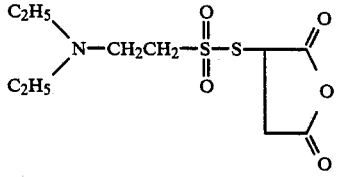
(8)
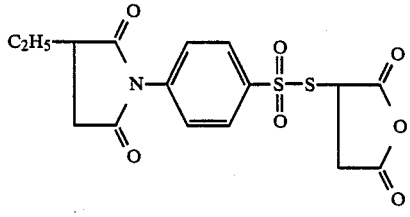
-continued
(9)
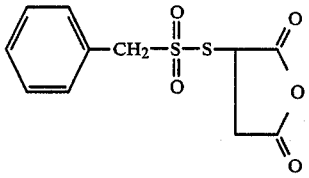
(10)
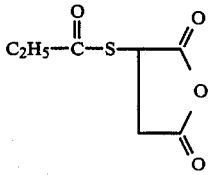
(11)
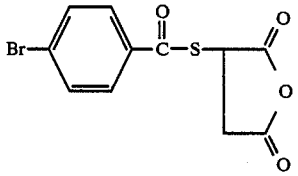
(12)
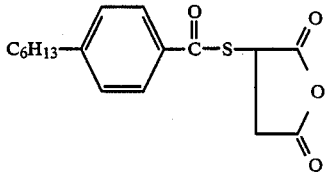
(13)
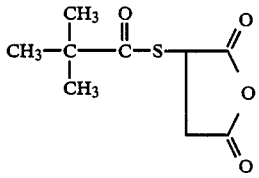
(14)
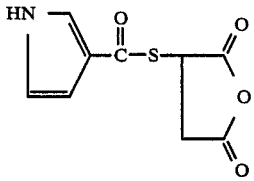
(15)
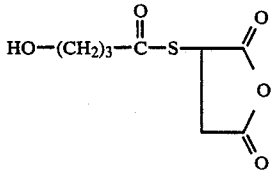
(16)
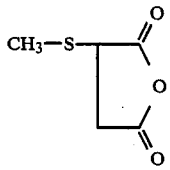

-continued (17)

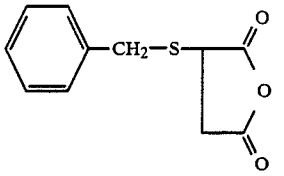

(18)

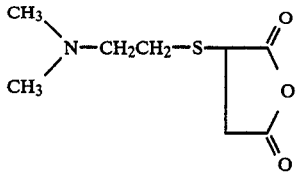

(19)

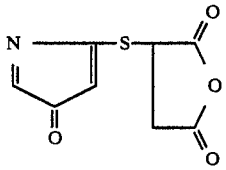

(20)

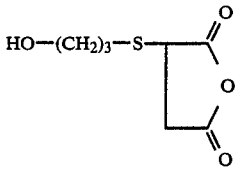

The compound of the above General Formula (Q) may be added preferably in an amount ranging between 0.1 mg and 1000 mg, particularly desirably between 1 mg and 100 mg, per 1 mole of silver halide. The amount less than 0.1 mg may give no effect of addition, and that more than 1000 mg may cause the saturation to give no remarkable effect of addition in such an increased amount. This compound may be usually used by dissolving it in a solvent such as water and methanol so as to be in the concentration of 0.1 to 1%.

A matte agent can be used in the light-sensitive material of the present invention. The matte agent that can be preferably used may include the organic matte agents disclosed in British Pat. No. 1,055,713; U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924, 3,767,448; etc., the inorganic matte agents disclosed in West German Pat. No. 25 29 321; British Pat. Nos. 760,775, 1,260,772; U.S. Pat. Nos. 1,201,905, 2,192,241, 3,053,662, 3,062,649, 3,257,206, 3,322,555, 3,353,958, 3,370,951, 3,411,907, 3,473,484, 3,523,022, 3,615,554, 3,635,714, 3,769,020, 4,021,245, 4,029,504; etc.

In the silver halide crystal used in the present invention, the iridium salt is preferably added to the surface of the crystal or the vicinity thereof. It may be added preferably in an amount of $10^{-5}$ to $10^{-1}$ mole per 1 mole of silver halide.

In the present invention, the emulsion may be sensitized by use of a sensitizer. For example, gold sensitization or sulfur sensitization can be applied. For this purpose, chloroauric acid, sodium thiocyanate, sodium thiosulfate, etc. can be used. Preferably, chloroauric acid may be added in an amount of $1.0\times10^{-5}$ to $1.0\times10^{-9}$ mole, more preferably $1\times10^{-6}$ to $1\times10^{-7}$ mole; sodium thiocyanate, in an amount of $2.0\times10^{-1}$ to $2.0\times10^{-5}$ mole, more preferably $2.8\times10^{-3}$ to $1.8\times10^{-4}$ mole; sodium thiosulfate, in an amount of $1.0\times10^{-4}$ to $1.0\times10^{-8}$ mole, more preferably $1.0\times10^{-5}$ to $1.0\times10^{-6}$ mole.

When the means of chemical sensitization is employed in the present invention, the method disclosed in Die Grundlagen der Photographischen Prozesse mit Silberhalogeniden, edited by H. Frieser (Akademische Verlagsgesellshaft) (1968), pp. 675–734, can be used for the chemical sensitization.

Namely, there can be used solely or in combination a sulfur sensitization method employing a compound or active gelatin containing sulfur capable of reacting with a silver ion, a reduction sensitization method employing a reducible substance, a noble metal sensitization method employing a noble metal compound such as gold and others, and a selenium sensitization method. A sulfur sensitizer that can be used may include thiosulfates, thioureas, thiazoles, rhodanines and other compounds, and specific examples of these are disclosed in U.S. Pat. Nos. 1,574,944, 2,410,689, 2,278,947, 2,728,668, 3,656,955, 4,032,928 and 4,067,740. A reduction sensitizer that can be used may include stannous chloride, amines, hydrazine derivatives, formamidine sulfinic acid, silane compounds, etc., and specific examples of these are disclosed in U.S. Pat. Nos. 2,487,850, 2,419,974, 2,518,698, 2,983,609, 2,983,610, 2,694,637, 3,930,867 and 4,054,458. For the noble metal sensitization, there can be used, besides gold complex salts, complex salts of platinum, iridium, palladium, etc. which are Group VIII metals in the periodic table, and specific examples thereof are disclosed in U.S. Pat. Nos. 2,399,083, 2,448,060; British Pat. No. 618,061; etc. The selenium sensitization is preferably carried out by using, for example, selenathio urea or the like.

In silver halide grains of the present invention, any of these chemical sensitization methods may be used, and it is also possible to use them in combination of two or more.

It is particularly preferable to use gold sensitization and sulfur sensitization in combination.

When working the present invention, a stabilizer can be added after completion of the chemical sensitization mentioned above. For example, there can be used various stabilizers including 4-hydroxy-6-methyl-1,3,3a,7-tetrazaindene, 5-mercapto-1-phenyltetrazole, 2-mercaptobenzothiazole, etc.

It is also possible to carry out optical sensitization to a desired wavelength region by using solely or in combination, if necessary, optical sensitizers such as cyanine dyes, merocyanine dyes, etc.

For example, there can be used the dyes disclosed in U.S. Pat. Nos. 2,493,784, 2,519,001, 2,977,229, 3,480,343, 3,672,897, 3,073,377, 2,688,545, 2,912,329, 3,397,060, 3,511,664, 3,522,052, 3,527,641, 3,615,613, 3,615,832, 3,615,635, 3,615,641, 3,617,295, 3,617,293, 3,628,964, 3,835,721, 3,656,959, 3,694,217, 3,743,510, 3,769,301, 3,793,020, etc.

The sensitizing dyes preferably usable in the present invention may include the compounds represented by the following General Formulas (I) and (II).

Photographic emulsions can be sensitized to a high sensitivity by incorporating in the emulsions the dye represented by General Formula (I) and the dye represented by General Formula (II).

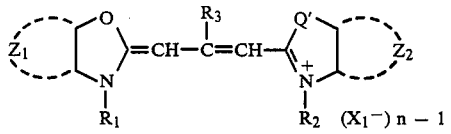

$R_1$ and $R_2$ each represent a substituted or unsubstituted alkyl group, alkenyl group or aryl group, and at least one of $R_1$ and $R_2$ is a sulfoalkyl group or a carboxyalkyl group.

$R_3$ represents a hydrogen atom, a lower alkyl group or an aryl group;

$X_1^-$ represents an anion, and Q' represents O or N;

$Z_1$ and $Z_2$ each represent a group of non-metallic atoms necessary for the completion of a substituted or unsubstituted benzene ring; and n is 1 or 2 (provided, however, that n=1 when an intramolecular salt is formed).

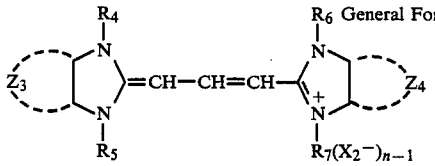

General Formula (II)

$R_4$ and $R_6$ each represent a substituted or unsubstituted lower alkyl group;

$R_5$ and $R_7$ each represent a lower alkyl group, a hydroxyalkyl group, a sulfoalkyl group, a carboxyalkyl group;

$X_2^-$ represents an anion;

$Z_3$ and $Z_4$ each represent a group of non-metallic atoms necessary for the completion of a substituted or unsubstituted benzene ring; and n is 1 or 2 (provided, however, that n=1 when an intramolecular salt is formed).

In General Formula (I), the substituted or unsubstituted alkyl group represented by $R_1$ and $R_2$ may specifically include, for example, as the unsubstituted alkyl group, lower alkyl groups such as methyl, ethyl, n-propyl and butyl. The substituted alkyl group of $R_1$ and $R_2$ may include, for example, vinylalkyl groups such as vinylmethyl; hydroxyalkyl groups such as 2-hydroxyethyl and 4-hydroxybutyl; acetoxyalkyl groups such as 2-acetoxyethyl and 3-acetoxybutyl; carboxyalkyl groups such as 2-carboxyethyl, 3-carboxypropyl and 2-(2-carboxyethoxy)ethyl; sulfoalkyl groups such as 2-sulfoethyl, 3-sulfopropyl, 3-sulfobutyl, 4-sulfobutyl and 2-hydroxy-3-sulfopropyl. The alkenyl group represented by $R_1$ and $R_2$ may include allyl, butynyl, octenyl or oleyl, etc., and those to which a substituent is attached. Further, the substituted or unsubstituted aryl group represented by $R_1$ and $R_2$ may include phenyl, carboxy phenyl, etc., provided, however, that at least one of $R_1$ and $R_2$ is a sulfoalkyl group or a carboxyalkyl group as mentioned before.

In General Formula (I), $R_3$ represents a hydrogen atom, a lower alkyl group or an aryl group, and the lower alkyl group may include groups or methyl, ethyl, propyl, butyl, etc. An example of the aryl group includes a phenyl group. A substituent may be attached to these.

In General Formula (I), also, the anion represented by $X_1^-$ may include, for example, a chloride ion, a bromide ion, an iodide ion, a thiocyanide ion, a sulfate ion, a perchlorate ion, a p-toluene sulfonate ion, an ethylsulfonate ion, etc.

Typical examples of this compound represented by General Formula (I) are shown below:

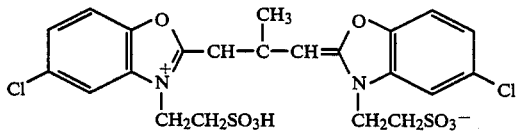

(1)

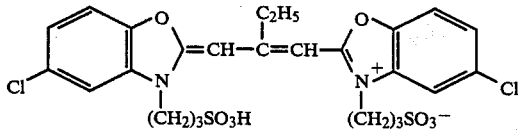

(2)

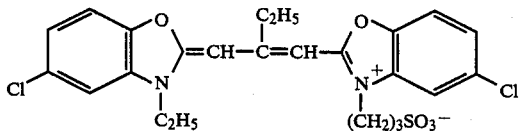

(3)

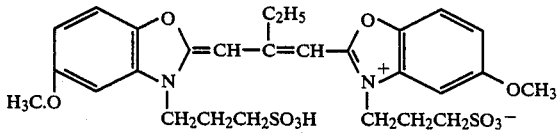

(4)

-continued
(5)
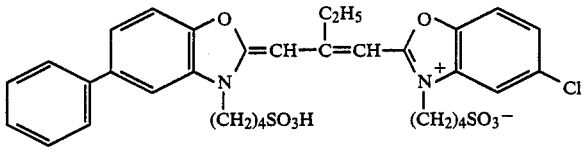
(6)
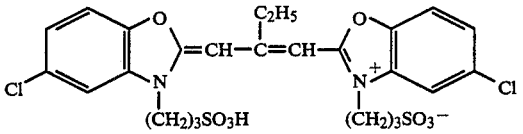
(7)
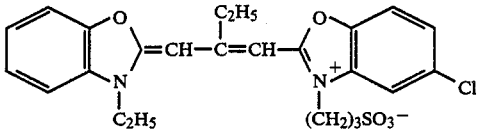
(8)
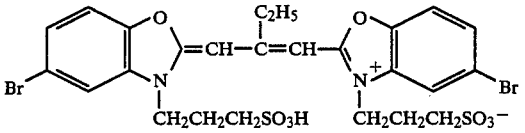
(9)
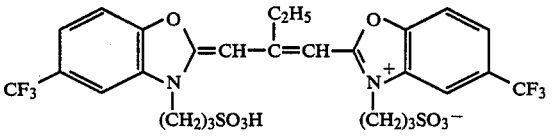
(10)
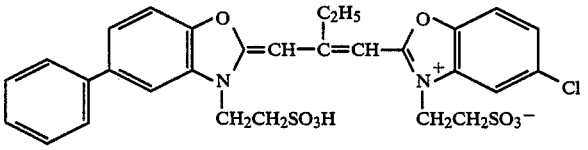
(11)
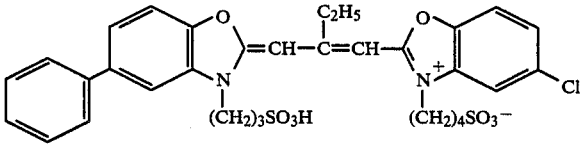
(12)
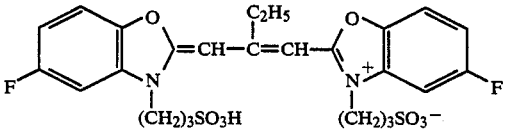
(13)
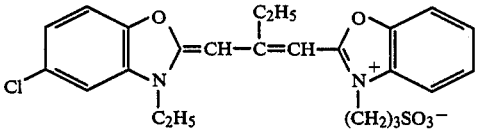
(14)
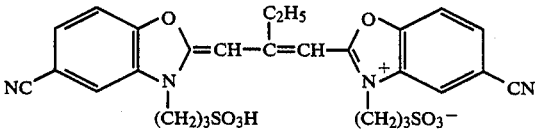

-continued
(15)
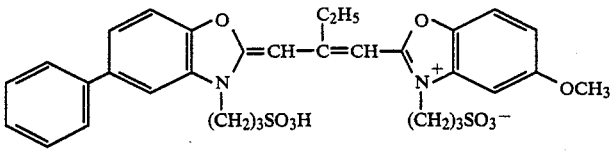
(16)
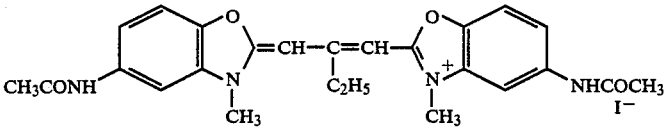
(17)
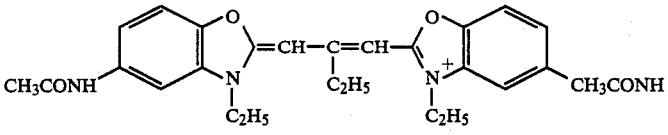
(18)
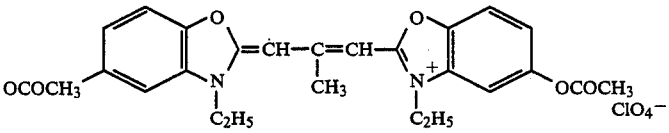
(19)
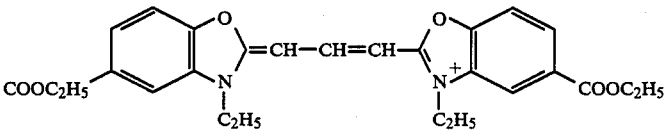
(20)
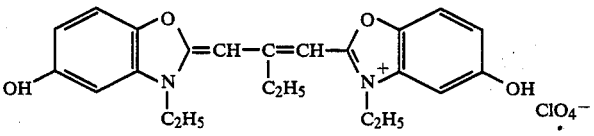
(21)
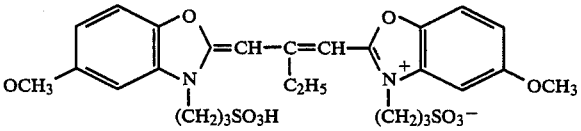
(22)
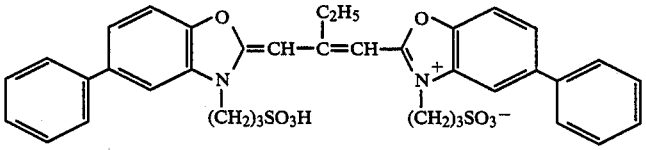
(23)
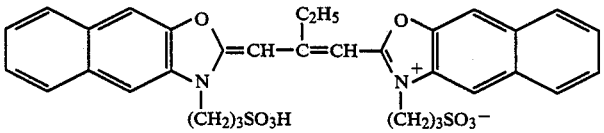
(24)
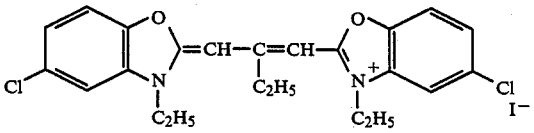

-continued
(25)
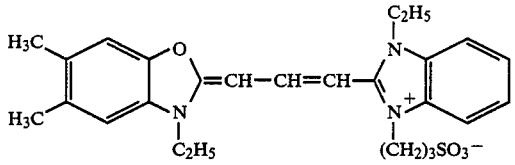
(26)
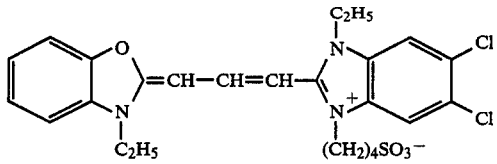
(27)
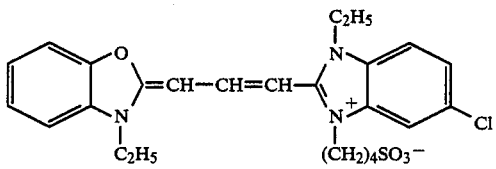
(28)
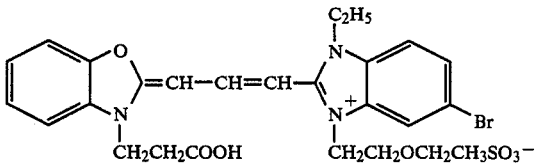
(29)
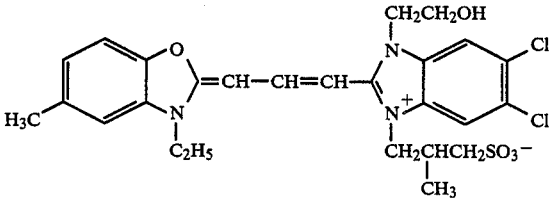
(30)
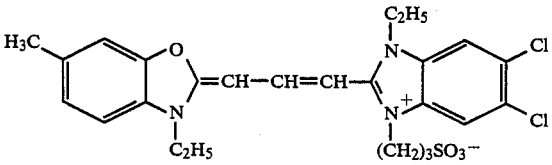
(31)
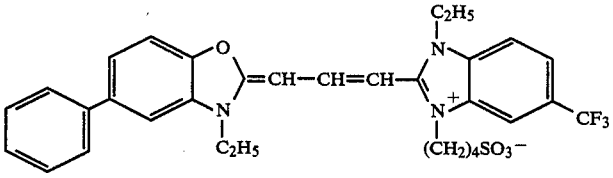
(32)
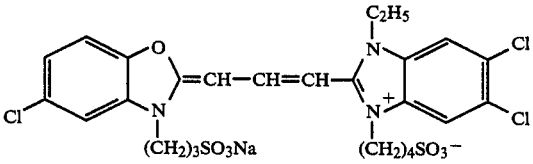
(33)
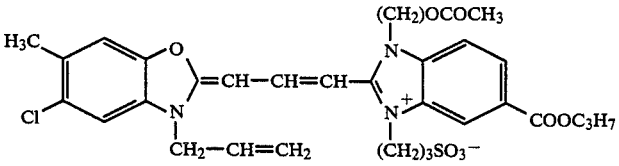

-continued
(34)
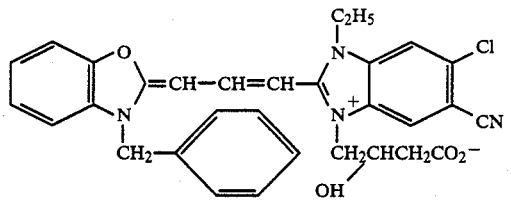
(35)
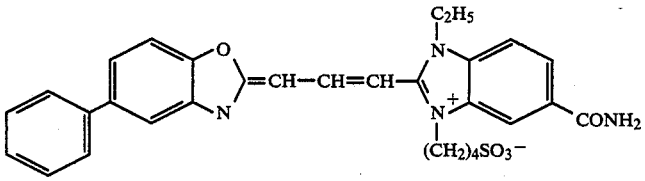
(36)
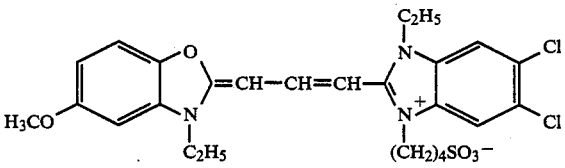
(37)
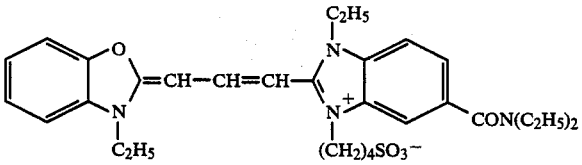
(38)
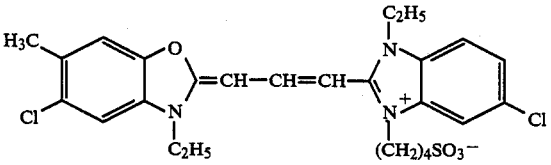
(39)
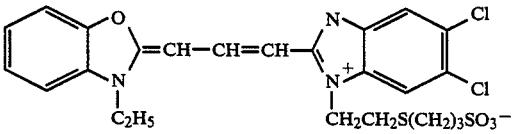
(40)
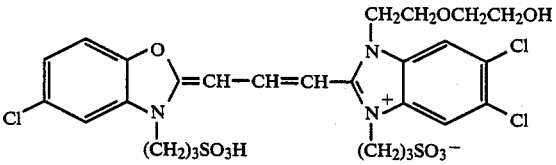
(41)
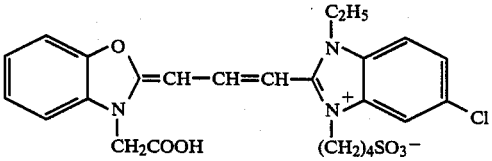
(42)
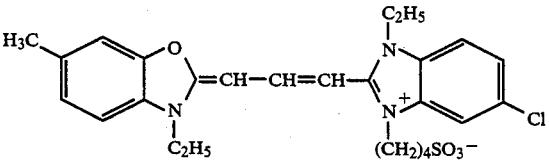

-continued (43)

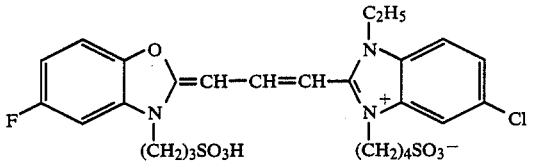

(44)

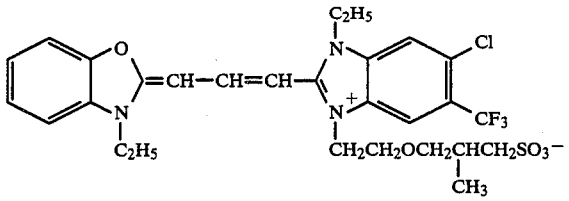

(45)

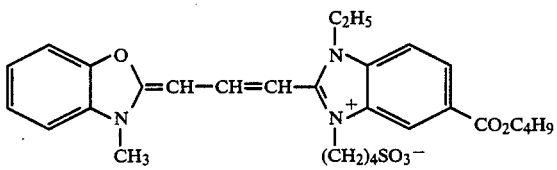

(46)

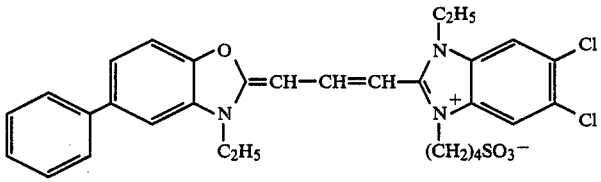

(47)

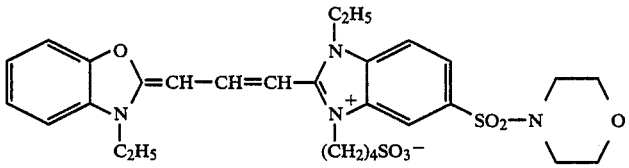

(48)

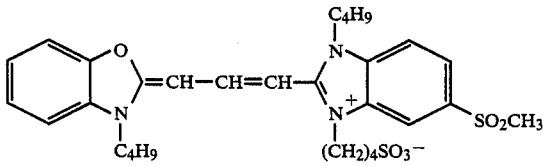

Next, in General Formula (II), the lower alkyl group represented by $R_4$ and $R_6$ may be exemplified by groups of methyl, ethyl, propyl, butyl, etc. The substituted alkyl group may include the groups exemplified for $R_1$ and $R_2$ in General Formula (I). The alkyl group represented by $R_5$ and $R_7$ may be exemplified by the groups same as those for $R_4$ and $R_6$. The hydroxyalkyl group, the sulfoalkyl group and the carboxyalkyl group each represented by $R_5$ and $R_7$ may include the groups exemplified for $R_1$ and $R_2$ in General Formula (I).

The anion represented by $X_2^-$ may also include those exemplified for $X_1^-$ in General Formula (I).

Typical examples of such compound represented by General Formula (II) are shown below:

(49)

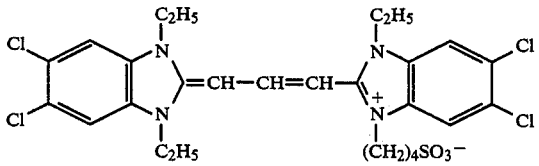

(50)

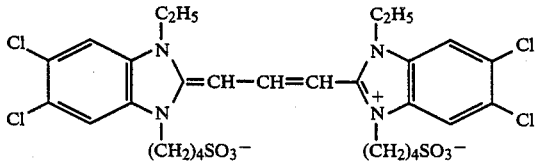

-continued
(51)
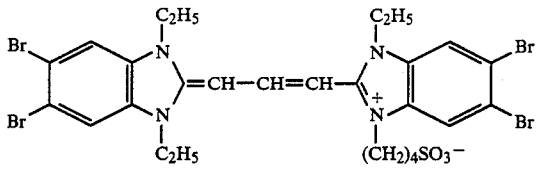
(52)
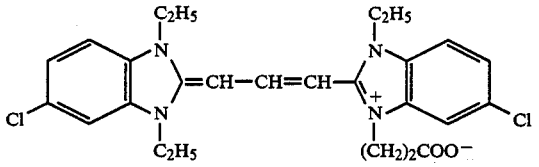
(53)
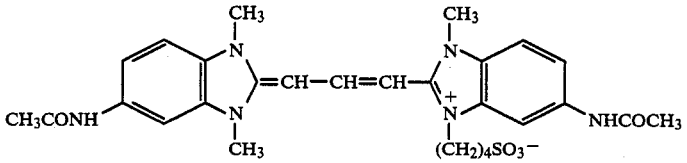
(54)
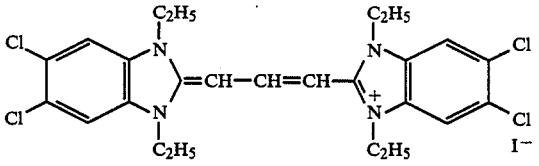
(55)
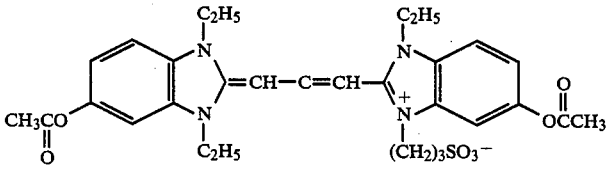
(56)
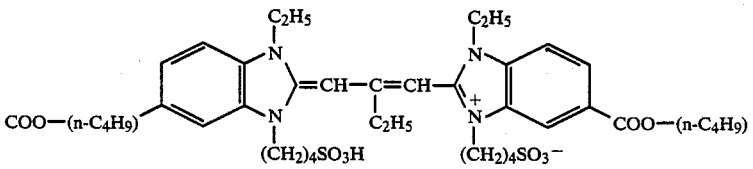
(57)
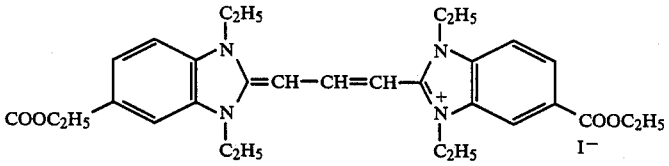
(58)
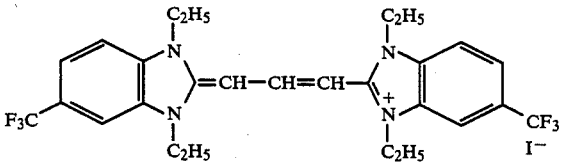
(59)
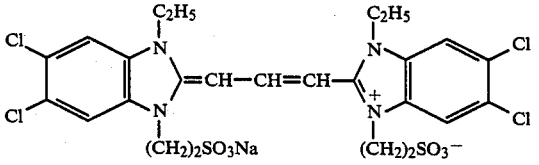

-continued
(60)
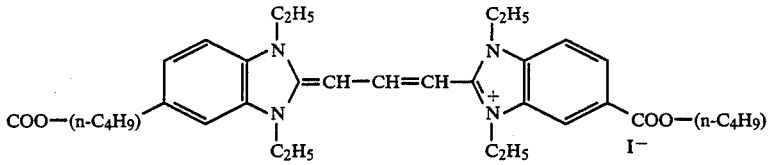
(61)
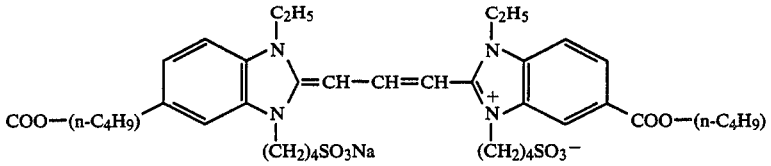
(62)
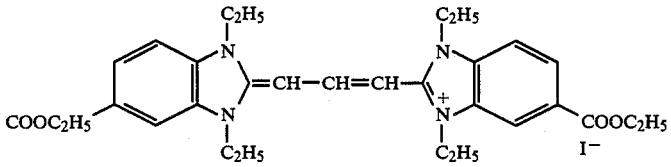
(63)
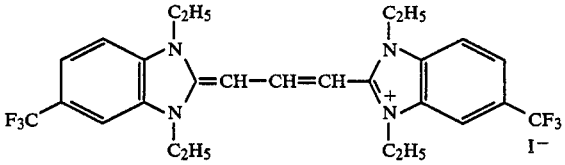
(64)
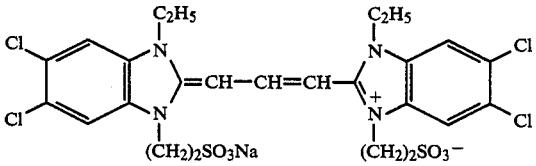
(65)
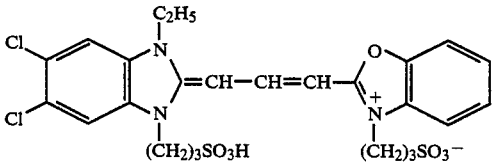
(66)
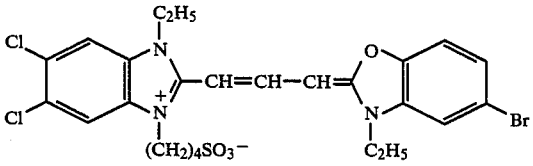
(67)
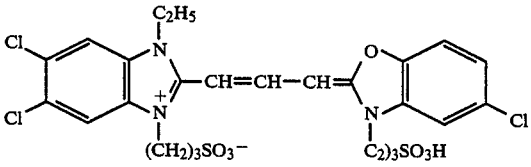
(68)
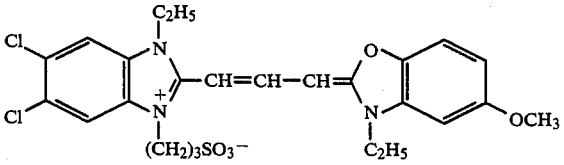

-continued
(69)
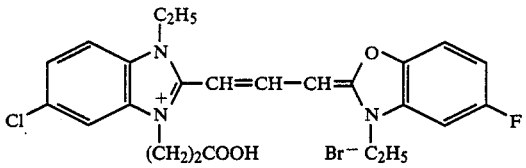
(70)
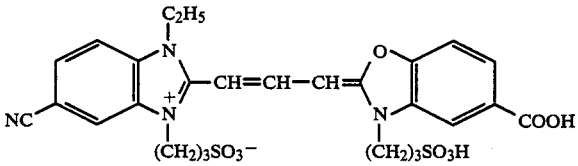
(71)
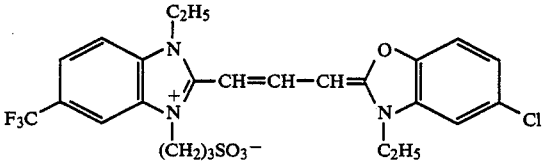
(72)
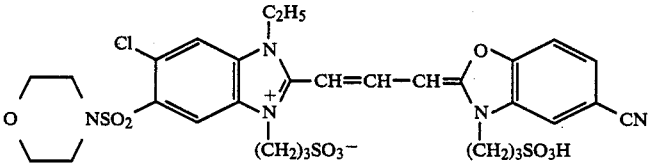
(73)
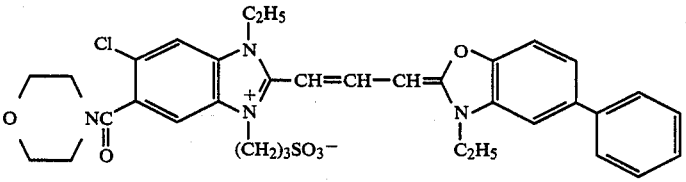
(74)
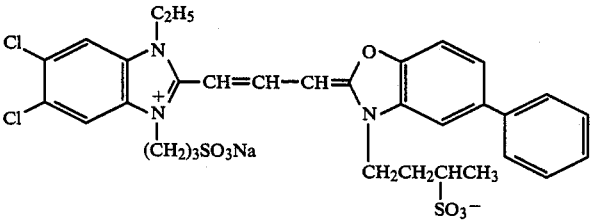
(75)
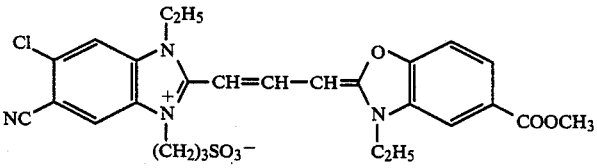
(76)
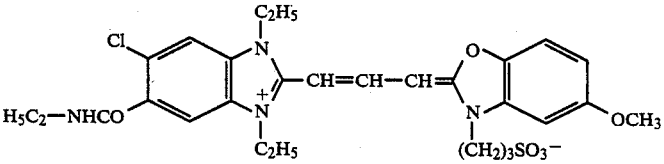
(77)
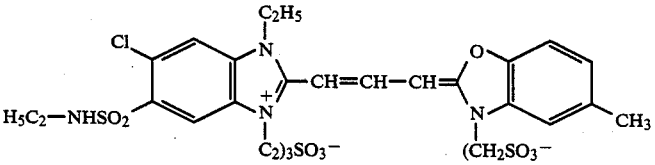

-continued (78)

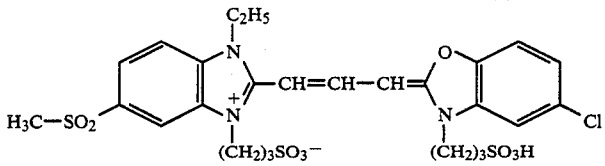

(79)

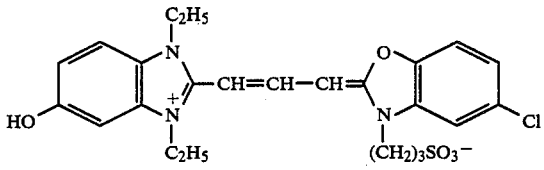

(80)

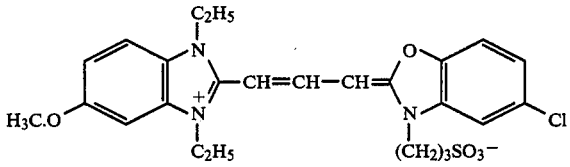

(81)

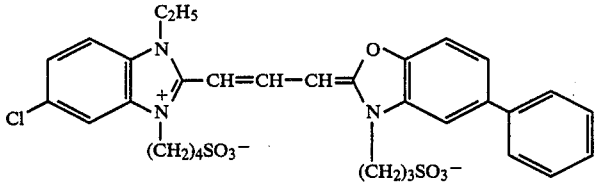

The compounds represented by the above General Formula (I) and (II), respectively, may be added in total preferably in an amount ranging between 5 mg and 600 mg, particularly preferably between 10 mg and 450 mg, per 1 mole of silver halide.

These dyes can be synthesized by various method, and can be readily synthesized, for example, by a known method.

Addition of these sensitizing dyes to a silver halide photographic emulsion may be added by dissolving them in an organic solvent such as methanol and ethanol which are missible with water.

These sensitizing dyes may be added to the above photographic emulsion at any time in the course of the preparation of the emulsion, but, particularly preferably, may be added immediately before, during, or after, the second ripening.

When it is added after the ripening, it is preferable to add potassium iodide before, after, or at the same time of, the addition of the dyes.

As a binding agent or protective colloid for the photographic emulsion of the present invention, it is advantageous to use gelatin, but other hydrophilic colloids can be also used.

For example, there can be used proteins such as gelatin derivatives, graft polymers of gelatin with other macromolecules, albumin, and casein; cellulose derivatives such as hydroxyethyl cellulose, carboxymethyl cellulose, and cellulose sulfate; saccharide derivatives such as sodium alginate and starch derivatives; and a variety of synthetic hydrophilic high molecular substances such as homopolymers or copolymers including polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole.

As the gelatin, lime treated gelatin, as well as acid treated gelatin, and enzyme treated gelatin as disclosed in Bull. Soc. Phot. Japan, No. 16, P. 30 (1966) may be used, and hydrolysate or enzyme decomposition product of gelatin can be also used. The gelatin derivatives that can be used may include those obtained by reacting gelatin with various compounds such as acid halides, acid anhydrides, isocyanates, bromoacetic acid, alkane sultones, vinyl sulfonamides, maleimide compounds, polyalkylene oxides and epoxy compounds.

Various compounds can be added to the above photographic emulsion in order to prevent sensitivity from being lowered or fog from being generated in the course of the production, the storage or the processing of light-sensitive materials.

That is, there can be added a variety of compounds having been known in this industry as stabilizers, including thiazoles, for example, benzothiazolinium salts, nitroindazoles, triazoles, benzotriazoles and benzimidazoles (in particular, nitro- or halogen-substituted compounds); heterocyclic mercapto compounds, for example, mercaptothiazoles, mercaptobenzothiazoles, mercaptobenzimidazoles (in particular, 1-phenyl-5-mercaptotetrazole) and mercaptopyridines; the above heterocyclic mercapto compunds comprising a water soluble group such as a carboxyl group and a sulfone group; thioketo compounds, for example, oxazolinethione; azaindenes, for example, tetrazaindenes (in particular, 4-hydroxy-substituted(1,3,3a,7)tetrazaindenes); benzenethiosulonates; benzenesulfinic acid; etc.

An example of the compounds that can be used is disclosed in K. Mess, The Theory of Photographic Process, Vol. 3 by referring to the original disclosure.

More detailed examples and how to use of these are made available by making reference to the disclosures, for example, in U.S. Pat. Nos. 3,954,474, 3,982,947 and 4,021,248, or Japanese Patent Examined Publication No. 28660/1977.

The antifoggants or stabilizers particularly preferably usable in the present invention include the compounds represented by General Formulas (III), (IV), (V) and (VI), respectively, shown below and a nitron compound.

Also, besides the above antifoggants, the antifoggants disclosed in Japanese O.P.I. Publications Nos. 74738/1982 and 217928/1983 may be particularly preferably used.

General Formula (III)

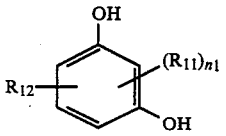

General Formula (IV)

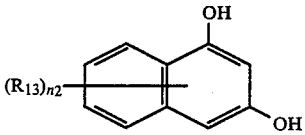

General Formula (V)

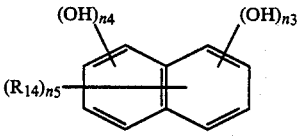

In the formula, $R_{11}$ each may be the same or different and represents a hydrogen atom, a halogen atom, a hydroxyl group, an alkyl group which may have a substituent, an aralkyl group which may have a substituent, an alkoxy group which may have a substituent, an acyl group which may have a substituent, a carboxymethyl group which may have a substituent, a group of —COOM or a group of $SO_3M$ (wherein M represents a hydrogen atom, an alkali metal atom or an ammonium group); $R_{12}$, $R_{13}$ and $R_{14}$ each represent a group of —COOM or a group of —$SO_3M$ (wherein M is as defined above); $n_1$ and $n_2$ represent an integer of 1 to 3; $n_3$ represent 1 or 2; and $n_3$ and $n_4$ represent 0 or 1; provided, however, that $n_3$ and $n_4$ each are not 0 at the same time.

General Formula (VI)

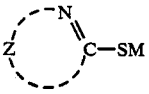

In the formula, Z represents a group of atoms necessary for the formation of a 5- or 6-membered heterocyclic ring comprising a carbon atom, a nitrogen atom, an oxygen atom or a sulfur atom.

This heterocyclic ring may be combined. For example, there are included tetrazole, triazole, imidazole, thiadiazole, oxadiazole, oxazole, benzthiazole, benzimidazole, benzoxazole, purine, azaindene, tri-, tetra- or pentapyridine and pyrimidine. Also, these heterocyclic rings may be substituted with an alkyl group, an alkoxy group, a carboxy group, a sulfo group, a hydroxyl group, an amino group, a nitro group, a halogen atom, a carbamoyl group, an alkylthio group, a mercapto group, etc. Of these, preferable ones are the compounds wherein Z is represented by tetrazole, triazole, thiadiazole, benzimidazole or benzthiazole, and most preferable ones are thiadiazole compounds. In the formula, M represents a hydrogen atom, a group of —$NH_4$, or an alkali metal atom.

Typical examples of the compound represented by the above General Formula (III) that can be used in the present invention may include the following:

III-(1)

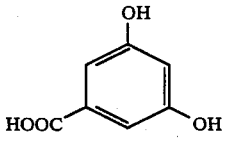

III-(2)

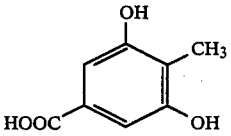

III-(3)

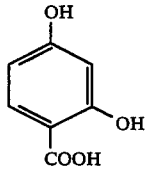

III-(4)

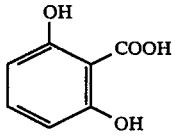

III-(5)

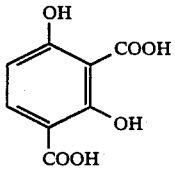

III-(6)

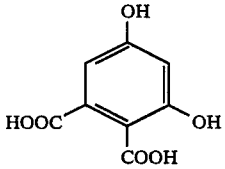

III-(7)

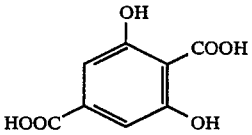

III-(8)

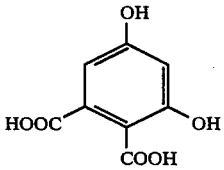

III-(9)

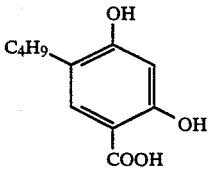

-continued
III-(10)
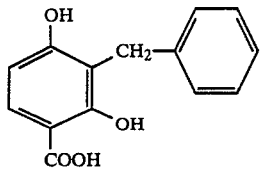
III-(11)
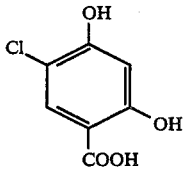
III-(12)
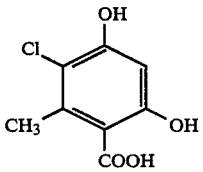
III-(13)
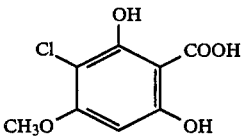
III-(14)
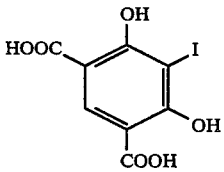
III-(15)
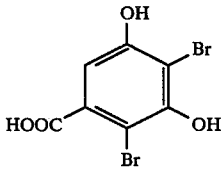
III-(16)
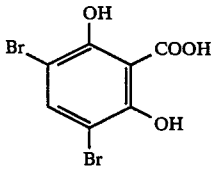
III-(17)
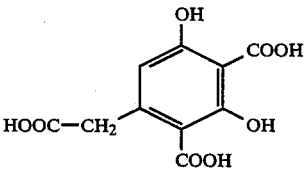
III-(18)
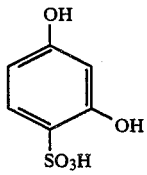
-continued
III-(19)
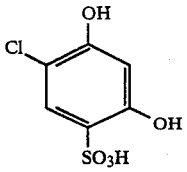
III-(20)
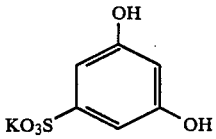
III-(21)
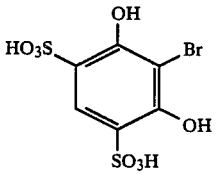
III-(22)
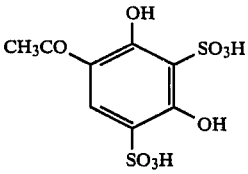
III-(23)
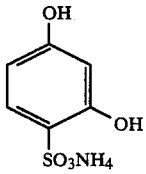
III-(24)
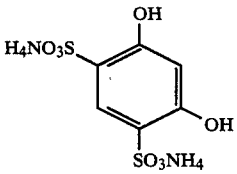
III-(25)
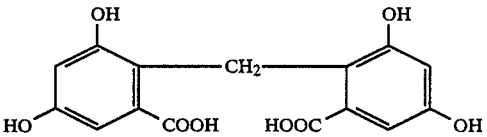
III-(26)
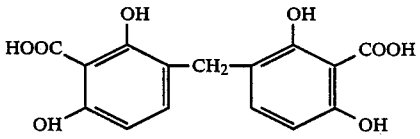
Typical examples of the compound represented by General Formula (IV) may include the following:
IV-(1)
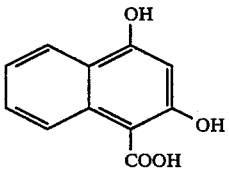

-continued
IV-(2)
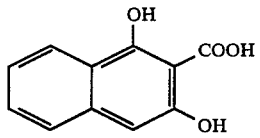
IV-(3)
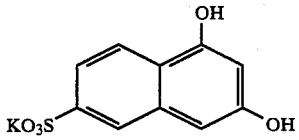
IV-(4)
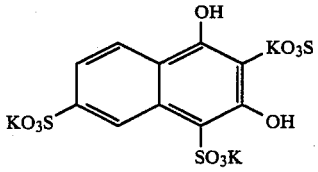
Also, typical examples of the compound represented by General Formula (V) may include the following:
V-(1)
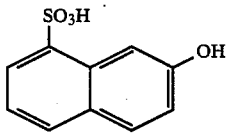
V-(2)
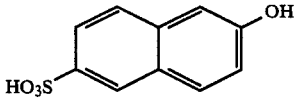
V-(3)
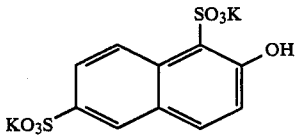
V-(4)
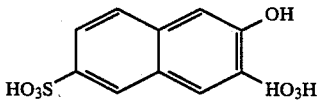
V-(5)
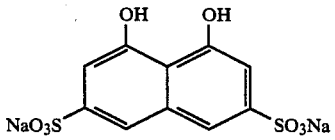
V-(6)
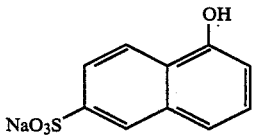
V-(7)
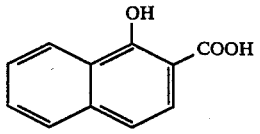
V-(8)
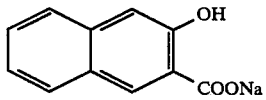
-continued
V-(9)
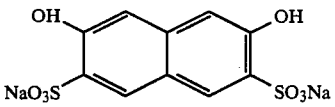
V-(10)
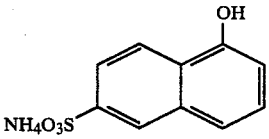
Preferable examples of the compound represented by General Formula (VI) may include the following:
VI-(1)
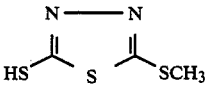
VI-(2)
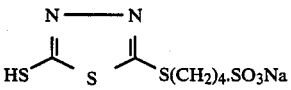
VI-(3)
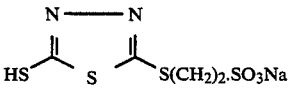
VI-(4)
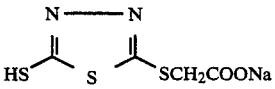
VI-(5)
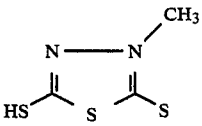
VI-(6)
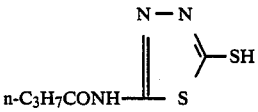
VI-(7)
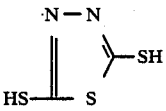
VI-(8)
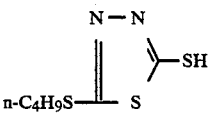
VI-(9)
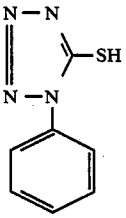

-continued
VI-(10)
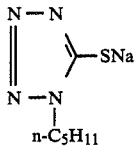
VI-(11)
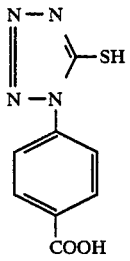
VI-(12)
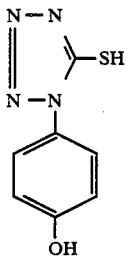
VI-(13)
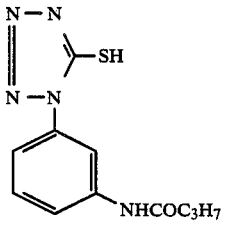
VI-(14)
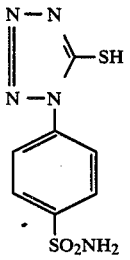
VI-(15)
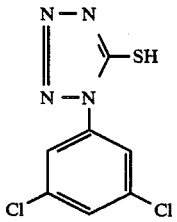
VI-(16)
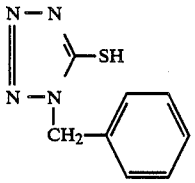
-continued
VI-(17)
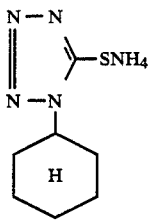
VI-(18)
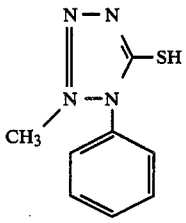
VI-(19)
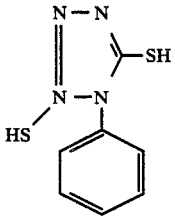
VI-(20)
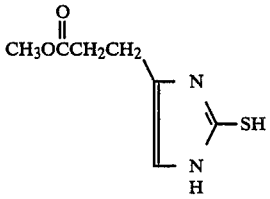
VI-(21)
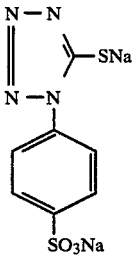
VI-(22)
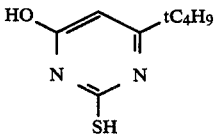
VI-(23)
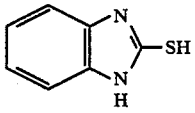
VI-(24)
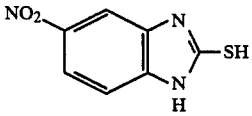

-continued

VI-(25)

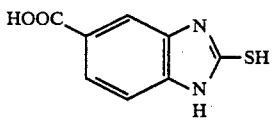

VI-(26)

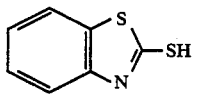

VI-(27)

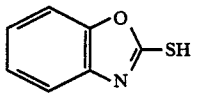

VI-(28)

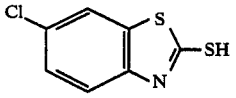

VI-(29)

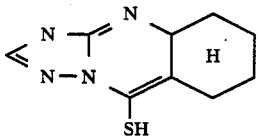

The above compounds can be preferably used by adding $5\times10^{-8}$ to $5\times10^{-3}$ mole per 1 mole of silver.

The compound represented by General Formula (VIIa) shown below can be preferably used in the present invention.

General Formula (VIIa)

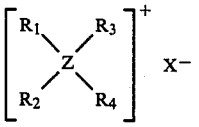

In General Formula (VIIa), Z represents a phosphorus atom or a nitrogen atom; $R_1$, $R_2$, $R_3$ and $R_4$ each represent a substituted or unsubstituted alkyl group, aryl group or aralkyl group, provided, however, that at least one of $R_1$, $R_2$, $R_3$ and $R_4$ is an aryl group or aralkyl group having an electron attractive substituent. $X^-$ represents an acid anion.

In the compound represented by General Formula (VIIa), particularly usefully usable compound is preferably the compound represented by General Formula (VIIb) shown below:

General Formula (VIIb)

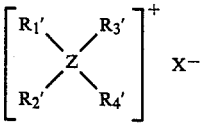

In General Formula (VIIb), Z represents a phosphorus atom or a nitrogen atom; $R_1'$, $R_2'$, $R_3'$ and $R_4'$ each represent a substituted or unsubstituted alkyl group having 1 to 6 carbon atoms, phenyl group, tolyl group, xylyl group, biphenyl group, naphthyl group or anthryl group, or a group of

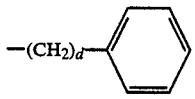

(d: an integer of 1 to 6). Here, the substituent may include $-CH_3$, OH, —CN, $-NO_2$, a halogen atom, a carbonyl group, a carboxyl group, a sulfonyl group or a quaternary amino group, and the number of the substituent is 1 or 2, provided, however, that at least one of $R_1'$, $R_2'$, $R_3'$ and $R_4'$ is an aryl group or aralkyl group having an electron attractive substituent, for example, a nitro group, a cyano group, a halogen atom, a carbonyl group, a carboxyl group, a sulfonyl group, a quaternary amino group. $X^-$ represents an acid anion, for example, $Br^-$, $Cl^-$, $I^-$, $ClO_4^-$ and $BF_4^-$.

The compounds represented by the above General Formula (VIIa) or (VIIb) can by synthesized according to the method disclosed in U.S. Pat. No. 3,951,661.

Typical examples of the compounds represented by General Formulas (VIIa) and (VIIb) that can be preferably used in the present invention are as follows:

Exemplary Compounds:

(VII-1)

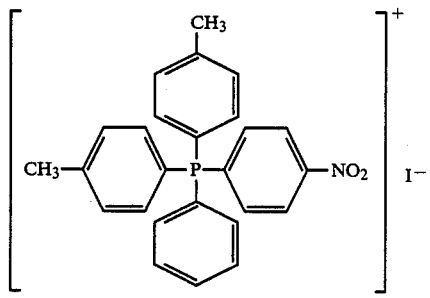

(VII-2)

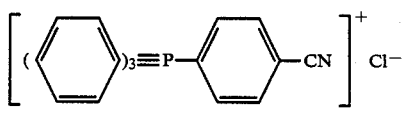

(VII-3)

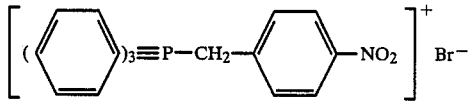

(VII-4)

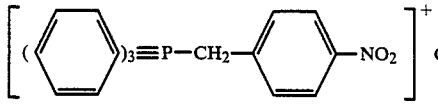

(VII-5)

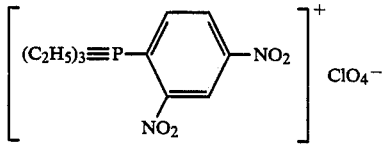

(VII-6)

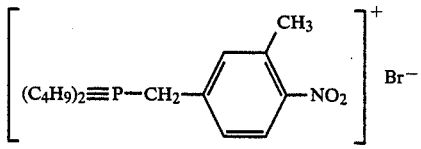

-continued (VII-7)

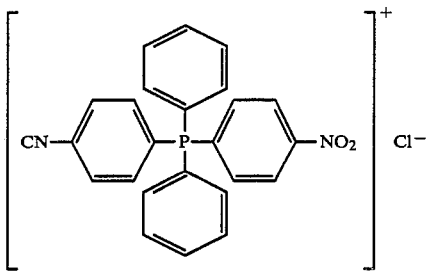

(VII-8)

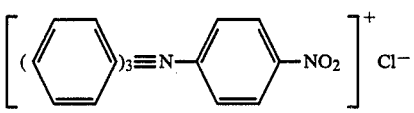

(VII-9)

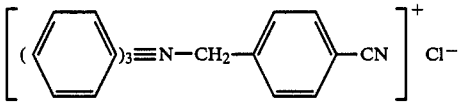

(VII-10)

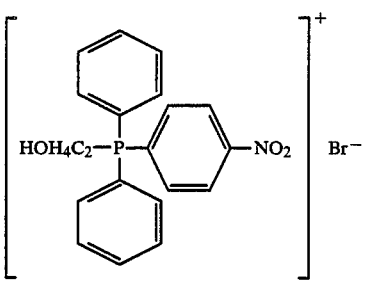

(VII-11)

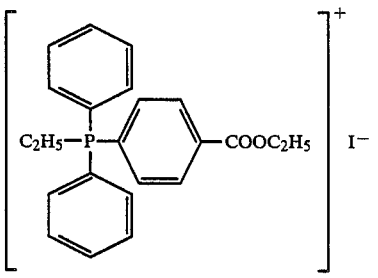

(VII-12)

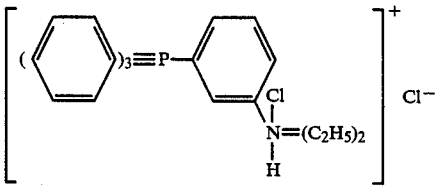

(VII-13)

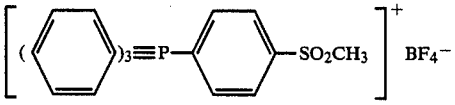

(VII-14)

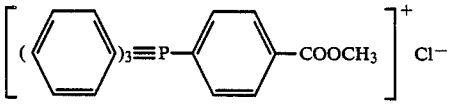

-continued (VII-15)

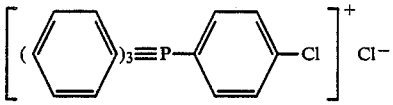

(VII-16)

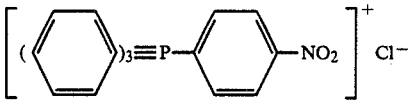

The nitro compounds that can be used as antifoggants or stabilizers may include various ones.

For example, there can be used the organic compounds, or inorganic salts or organic salts of the nitron compounds, disclosed in Journal of the Chemical Society, No. 1, pp. 824–825 (1938), which are represented by Structural Formula (VII) or (VIII) shown below, and specifically may include, for example, a chlorate, bromate, perchlorate, acid hydrogensulfide or acetate of the above nitron compounds.

Structural Formula (VII)

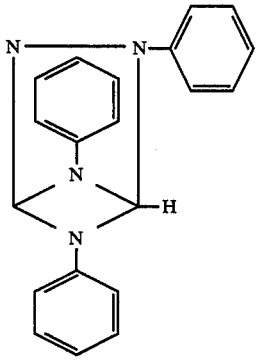

Structural Formula (VIII)

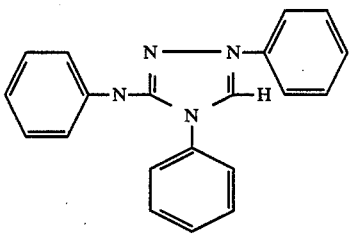

Besides, the following compounds disclosed in Japanese Patent O.P.I. Publications Nos. 122936/1985 and 117240/1985 can be also used.

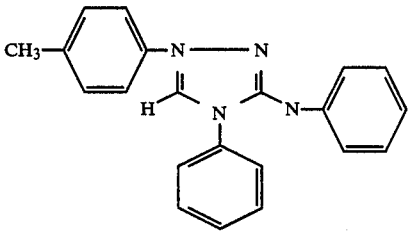

-continued

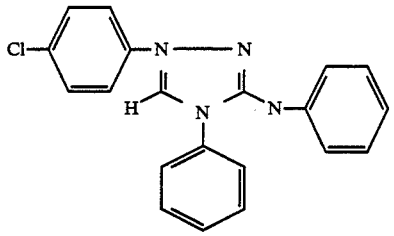

Further, the compound represented by General Formula (B) can be also used.

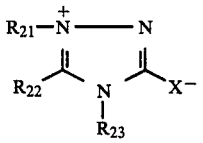

General Formula (B)

In the formula, X represents a sulfur atom or a group of $=N-R_{24}$; and $R_{21}$, $R_{22}$, $R_{23}$ and $R_{24}$ each represent a hydrogen atom, or a subtituted or unsubstituted alkyl group, aryl group or heterocyclic ring, provided, however, that, when $R_{24}$ is a hydrogen atom, $R_{21}$ to $R_{23}$ represent the one other than the hydrogen atom. $R_{21}$ and $R_{22}$, $R_{22}$ and $R_{23}$ and $R_{23}$ and $R_{24}$ each may be combined to form a ring.

In General Formula (B), the substituted or unsubstituted alkyl group refers to a substituted or unsubstituted straing chain alkyl group (such as methyl group, ethyl group and n-octyl group), a substituted or unsubstituted branched alkyl group (such as isopropyl group, isobutyl group, 2-ethylhexyl group and t-butyl group) and a substituted or unsubstituted cycloalkyl group (such as cyclopropyl group, cyclopentyl group and cyclohexyl group); and the substituted or unsubstituted aryl group refers to a substituted or unsubstituted phenyl group or naphthyl group. The substituted or unsubstituted heterocyclic ring refers to a substituted or unsubstituted 3-pyridyl group, 2-furyl group, a 2-benzothiazolyl group, etc.

Here, the substituent in $R_{21}$, $R_{22}$, $R_{23}$ and $R_{24}$ may include a halogen atom, a nitro group, a cyano group, an alkoxy group, a carbamoyl group, a sulfamoyl group, a carboxyl group, an alkoxycarbonyl group, a sulfo group, an amide group, a sulfonamide group, a hydroxyl group, a sulfonyl group, a sulfinyl group, a mercapto group, an amino group, a ureido group, an aminocarboxyl group, an alkoxycarbonylamino group, an aryl group and a heterocyclic ring, which may be contained one or more.

$R_{21}$ and $R_{22}$, $R_{22}$ and $R_{23}$ and $R_{23}$ and $R_{24}$ may further be combined each other to form a ring (for example, a 5-membered ring and a 6-membered ring).

Examples of the meso-ionic triazolium compound of General Formula (B) are shown below, to which, however, the compounds usable in the present invention are by no means limited.

B-(1)

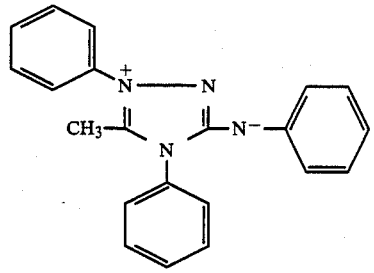

B-(2)

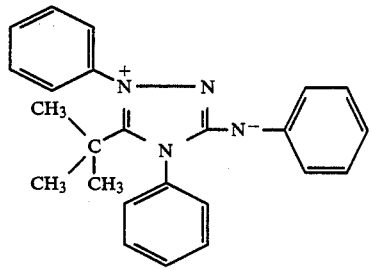

B-(3)

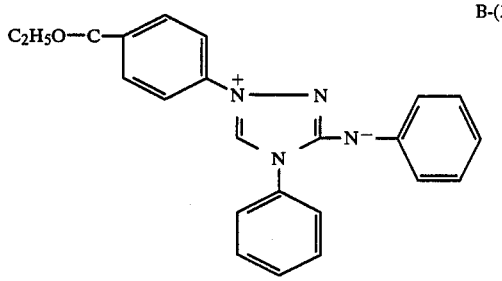

B-(4)

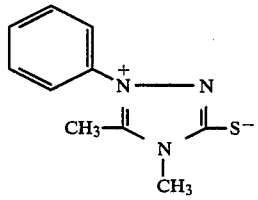

B-(5)

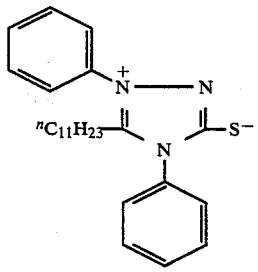

B-(6)

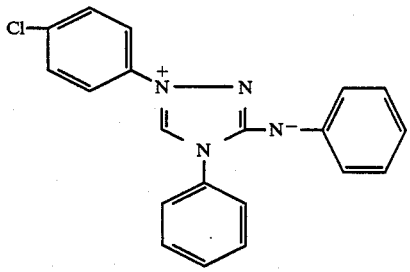

-continued

B-(7)

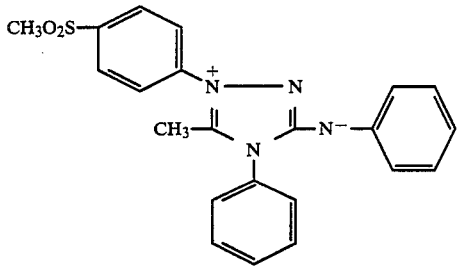

B-(8)

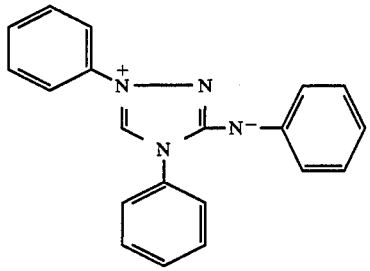

B-(9)

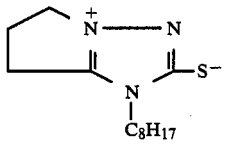

B-(10)

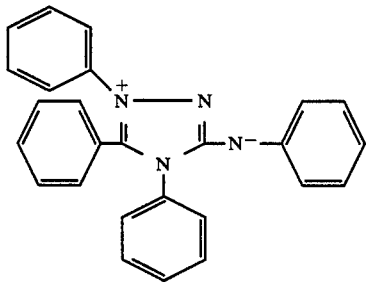

B-(11)

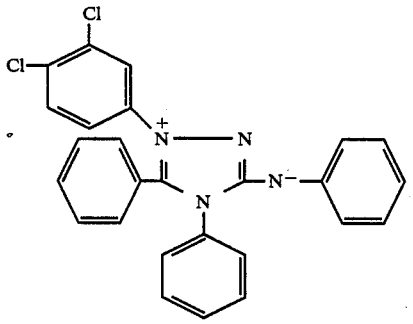

There is no particular limitation in development accelerators, and can be used compounds such as thioether compounds, benzimidazole compounds (for example, those disclosed in Japanese Patent O.P.I. Publication No. 24427/1974), quaternary ammonium salts and polyethylene glycol.

Various surface active agents may be contained in the photographic emulsion layers or other hydrophilic colloid layers of the light-sensitive photographic material of the present invention for the various purposes of coating auxiliary, antistatic, improvement of slidability, emulsification dispersion, prevention of sticking, and improvement of photographic characteristics (for example, development acceleration, high contrasting and sensitization).

For example, there can be used nonionic surface active agents such as saponins (of steroid type), alkylene oxide derivatives (for example, polyethylene glycol, polyethylene glycol/polypropylene glycol condensates, polyethylene glycol alkyl ethers or polyethylene glycols, alkylaryl ethers, polyethylene glycol esters, polyalkylene glycol alkylamines or amides, and addition products of polyethylene oxide with silicone), glycidol derivatives (for example, alkenylsuccinic acid polyglyceride and alkylphenol polyglyceride), aliphatic acid esters of polyhydric alcohols and alkyl esters of saccharides; anionic surface active agents containing an acidic group such as a carboxyl group, a sulfo group, a phospho group, a sulfuric acid ester group and a phosphoric acid ester group, including alkylcarbonates, alkylsulfonates, alkylbenzenesulfonates, akylnaphthalenesulfonates, alkylsulfuric acid esters, alkylophosphoric acid esters, N-acyl-N-alkyltaurinates, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkyl sulfuric acid or phosphoric acid esters, alkylbetaines and amine oxides; and cationic surface active agents such as alkylamine salts, aliphatic or aromatic quaternary ammonium salts, heterocyclic quaternary ammonium salts such as pyridinium and imidazolium, and aliphatic or heterocyclic ring-containing phosphonium or sulfonium salts.

A property improver can be also used, and there can be contained a polymer latex comprising a homo- or copolymer of an alkyl acrylate, an alkyl methacrylate, an acrylic acid, etc.

The photographic emulsion used in the present invention can be incorporated with an antistatic agent comprising a compound obtained by addition copolymerization of glycidol and ethylene oxide with a phenol-aldehyde condensate (for example, the one disclosed in Japanese Patent O.P.I. No. 56220/1976), a lanolin type ethylene oxide addition product and an alkali metal salt and/or alkaline earth metal (for example, the one disclosed in Japanese Patent O.P.I. Publication No. 145022/1978), a water soluble inorganic chloride and a matte agent (Japanese Patent Application No. 69242/1979), or (i) an addition condensate obtained by addition condensation of glycidol and ethylene oxide with a phenolaldehyde condensate and (ii) a fluorine-containing succinic acid compound (Japanese Patent Application No. 104940/1977).

The antistatic agent particularly preferably used in the present invention may include those represented by General Formulas (IX), (X), (XI) and (XII).

$$R—L—(CH_2CH_2O)_m—H$$

General Formula (IX)

wherein R represents a substituted or unsubstituted alkyl group, alkenyl group or aryl group; L represents an oxygen atom, a sulfur atom, a group of —N—R′, a group of $$-\underset{\underset{O}{\|}}{C}-N-R'$$

or a group of

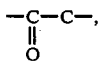

where R′ represents a hydrogen atom, a substituted or unsubstituted alkyl group or $-(CH_2CH_2O)_m-H$; and m represents an integer of 2 to 50.

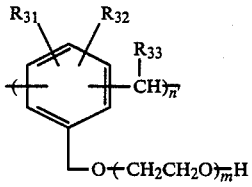

General Formula (X)

wherein $R_{31}$ and $R_{32}$ each represent a hydrogen atom, a halogen atom, an alkoxycarbonyl group, a substituted or unsubstituted alkyl group, alkoxy group or phenyl group; $R_{33}$ represents a hydrogen atom, a methyl group or an α-furyl group; and n′ and m each represent an integer of 2 to 50.

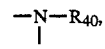

a group of

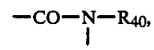

a group of

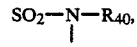

(wherein $R_{40}$ represents a hydrogen atom or a substituted or unsubstituted alkyl group).

The compound represented by General Formula (IX) used in the present invention may include the compounds represented by General Formulas as shown below.

General Formulas:

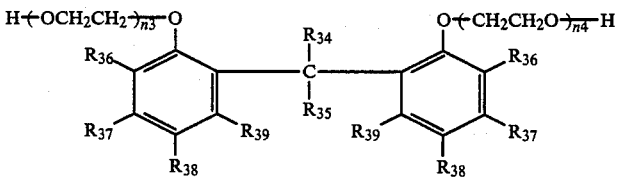

General Formula (XI)

In the formula, $R_{36}$ and $R_{38}$ each represent a halogen atom, or a substituted or unsubstituted alkyl group, aryl group, alkoxy group, acyl group, amide group, sulfonamide group, carbamoyl group or sulfamoyl group. In the general formula, the substituents on the phenyl rings may be bilaterally unsymmetric.

$R_{34}$ and $R_{35}$ each represent a hydrogen atom, a substituted or unsubstituted alkyl group or aryl group. $R_{34}$ and $R_{35}$, $R_{36}$ and $R_{37}$, and $R_{38}$ and $R_{39}$ may be combined with each other to form a substituted or unsubstituted ring.

In General Formulas (IX) to (XI), $n_1$, $n_2$, $n_3$ and $n_4$ each represent an average polymerization degree of ethylene oxide, and a number of 2 to 50.

Also, m represents an average polymerization degree, and a number of 2 to 50.

$Rf-A_1-(CH_2CH_2O)n_5-B-E$ General Formula (XII)

In the formula, Rf represents a substituted or unsubstituted alkyl group or alkenyl group having 1 to 30 carbon atoms and having been substituted in part or in entirety with fluorine atoms, or a substituted or unsubstituted aryl group.

B represents an alkenylene group, an alkylene group or an arylene group, or may not be present.

E represents a water soluble group or a hydrogen atom; and $n_5$ represents a number of 0 to 50.

$A_1$ represents a group of —O—, a group of —S—, a group of —COO—, a group of $R-O-((CH_2CH_2O)_m-H$ m=2 to 50 (IX)-(A)

R represents an alkyl group which may have an unsaturated bond, preferably those having 4 to 22 carbon atoms and wherein hydrogen atoms may be substituted with fluorine atoms.

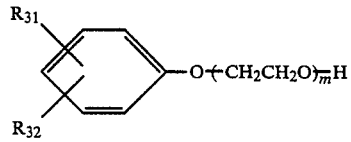

(IX)-(B)

m = 2~50

$R_{31}$ and $R_{32}$ may be the same or different, and each represent a hydrogen atom, a halogen atom, a carboxyl group, an acyl group, an alkoxycarbonyl group, an alkyl group, a substituted alkyl group, alkoxy group or phenyl group. Hydrogen atoms may be substituted with fluorine atoms.

$R-S-(CH_2CH_2O)_m-H$ m=2 to 50 (IX)-(C)

R represents an alkyl group which may have an unsaturated bond, preferably those having 4 to 22 carbon atoms and wherein hydrogen atoms may be substituted with fluorine atoms.

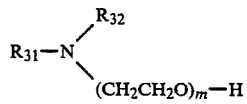

(IX)-(D)

-continued m = 2 to 50

$R_{31}$ represents an alkyl group, preferaly those having 1 to 20 carbon atoms; $R_{32}$ represents a hydrogen atom, an alkyl group (carbon atoms: 1 to 20), a fluorine substituted alkyl group, a phenyl group, an alkyl substituted phenyl group or a group of $-(CH_2CH_2O)_m-H$.

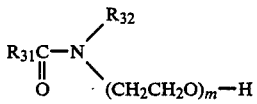

(IX)-(E)

m = 2 to 50

$R_{31}$ represents an alkyl group, preferably those having 1 to 20 carbon atoms; $R_{32}$ represents a hydrogen atom, an alkyl group (carbon atoms: 1 to 20), a fluorine substituted alkyl group, a phenyl group, an alkyl substituted phenyl group or a group of $-(CH_2CH_2O)_m-H$.

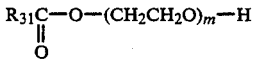

(IX)-(F)

m = 2 to 50

$R_{31}$ represents an alkyl group, and preferably those having 4 to 22 carbon atoms.

Among these compounds represented by General Formula (IX), the compounds particularly preferable in the present invention may include the following:

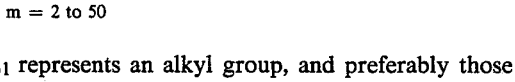

(IX)-(1)

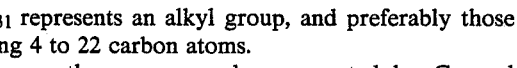

(IX)-(2)

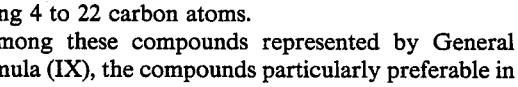

(IX)-(3)

(IX)-(4)

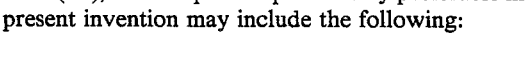

(IX)-(5)

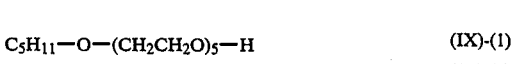

(IX)-(6)

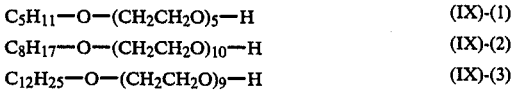

(IX)-(7)

(IX)-(8)

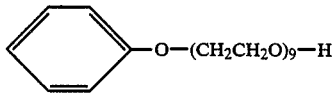

(IX)-(9)

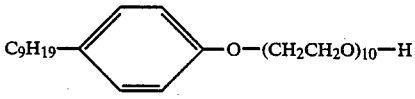

(IX)-(10)

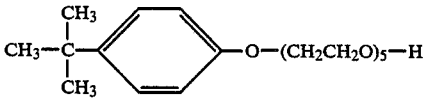

(IX)-(11)

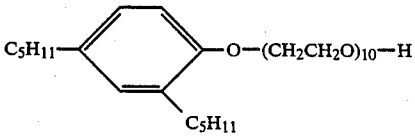

(IX)-(12)

-continued

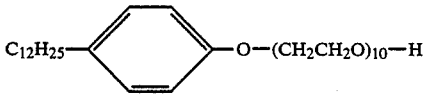

(IX)-(13)

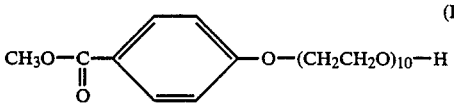

(IX)-(14)

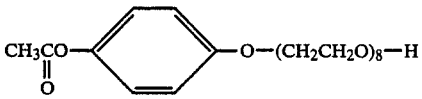

(IX)-(15)

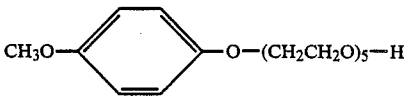

(IX)-(16)

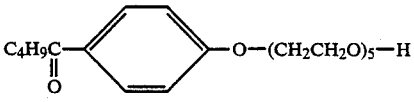

(IX)-(17)

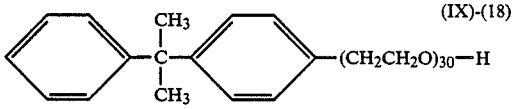

(IX)-(18)

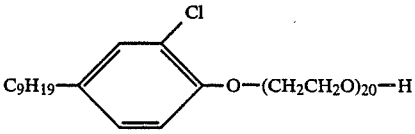

(IX)-(19)

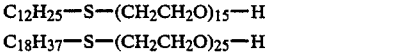

(IX)-(20)

(IX)-(21)

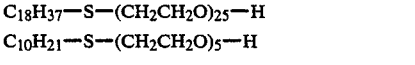

(IX)-(22)

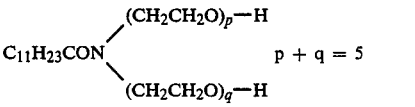

(IX)-(23)

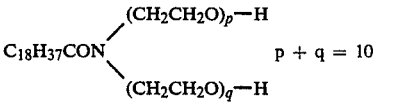

(IX)-(24)

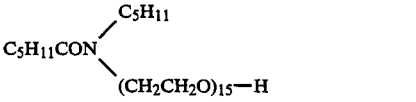

(IX)-(25)

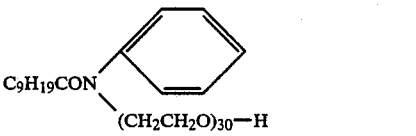

(IX)-(26)

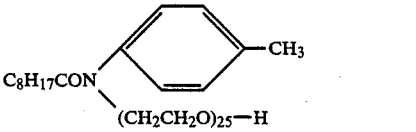

(IX)-(27)

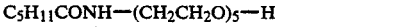

(IX)-(28)

-continued
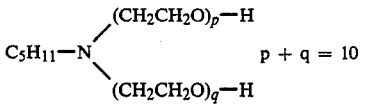
(IX)-(29)
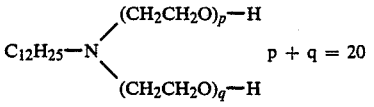
(IX)-(30)
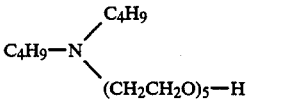
(IX)-(31)
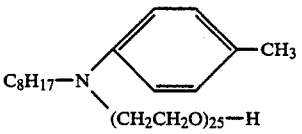
(IX)-(32)
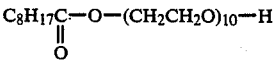
(IX)-(33)
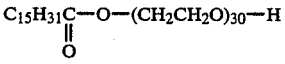
(IX)-(34)
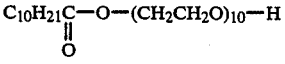
(IX)-(35)
Typical examples of the compound represented by General Formula (X) are shown below.
X-(1)
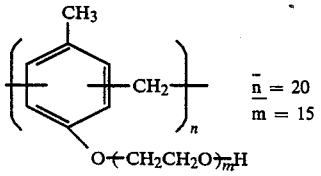
X-(2)
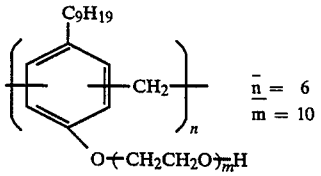
X-(3)
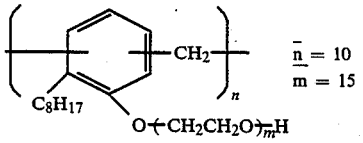
X-(4)
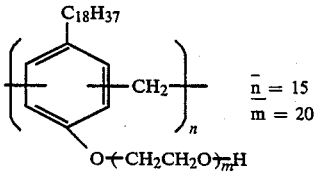
-continued
X-(5)
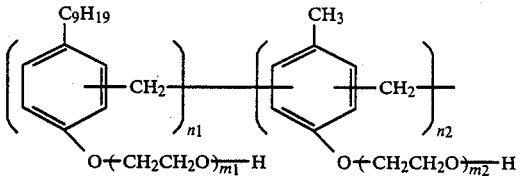
$n_1:n_2$ = 30:20
$m_1:m_2$ = 15
X-(6)
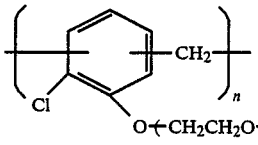
X-(7)
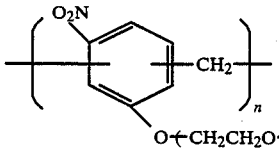
X-(8)
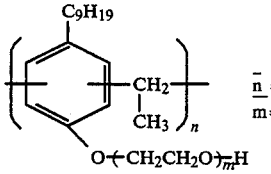
X-(9)
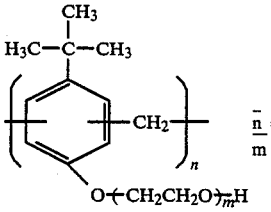
X-(10)
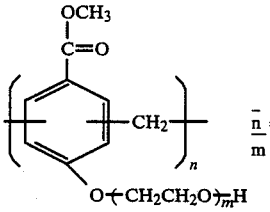
X-(11)
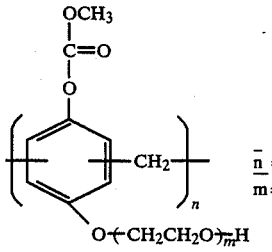
X-(12)
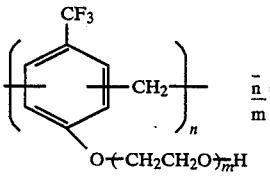

-continued
X-(13)
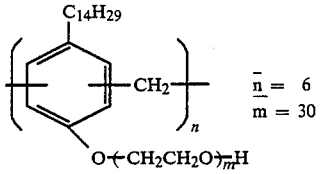
$\bar{n}$ = 6
m = 30
X-(14)
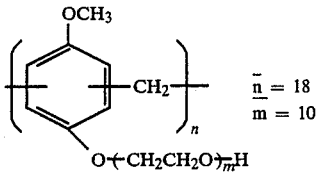
$\bar{n}$ = 18
m = 10
X-(15)
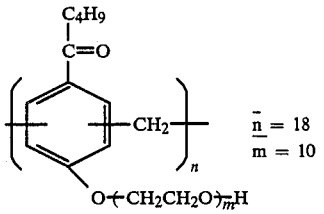
$\bar{n}$ = 18
m = 10
X-(16)
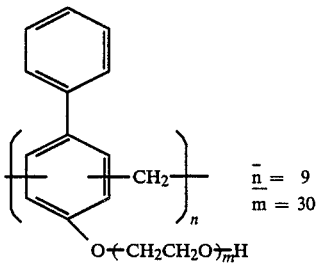
$\bar{n}$ = 9
m = 30
X-(17)
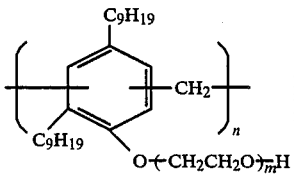
$\bar{n}$ = 10
m = 20
X-(18)
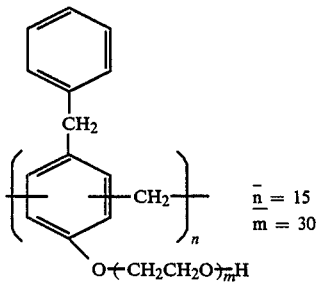
$\bar{n}$ = 15
m = 30
X-(19)
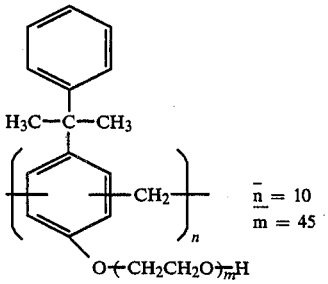
$\bar{n}$ = 10
m = 45
-continued
X-(20)
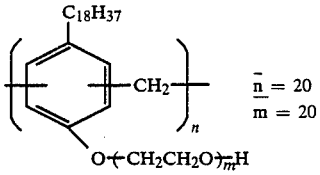
$\bar{n}$ = 20
m = 20
Examples of the compounds represented by General Formulas (XI) and (XII), respectively, used in the present invention may include the following:
XI-(1)
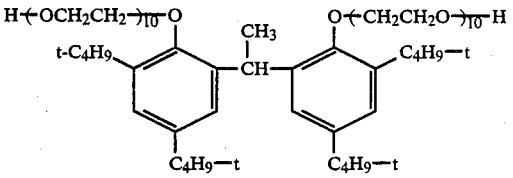
XI-(2)
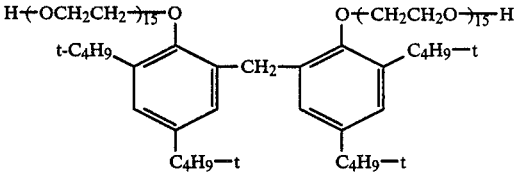
XI-(3)
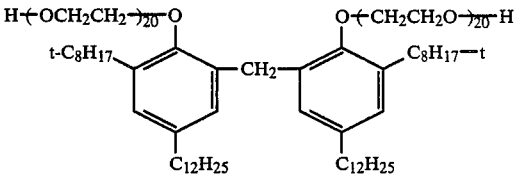
XI-(4)
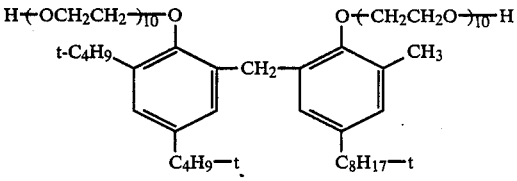
XI-(5)
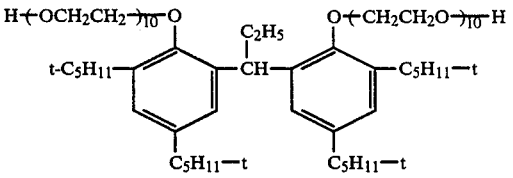
XI-(6)
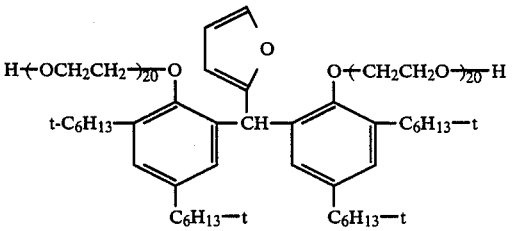

-continued

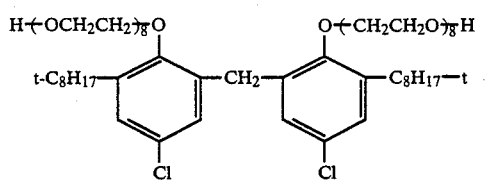

XI-(7)

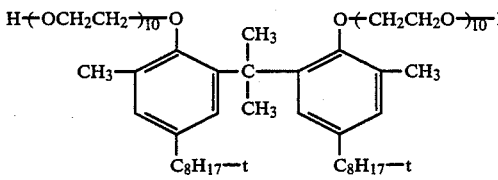

XI-(8)

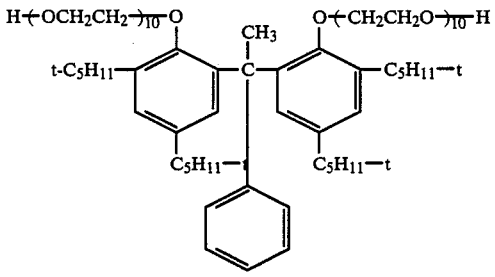

XI-(9)

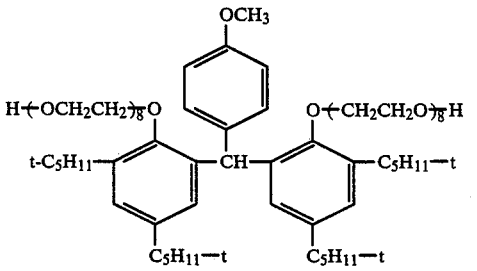

XI-(10)

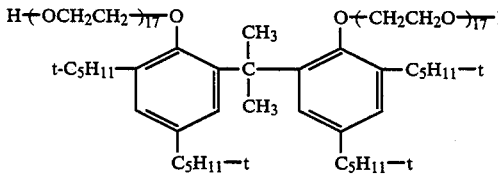

XI-(11)

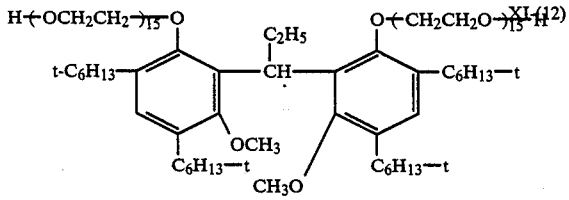

XI-(12)

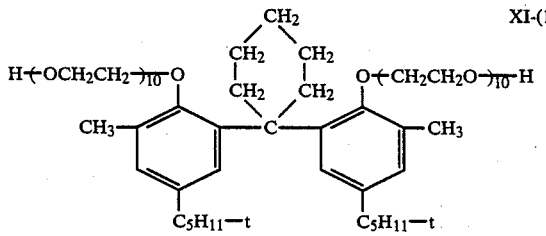

XI-(13)

-continued

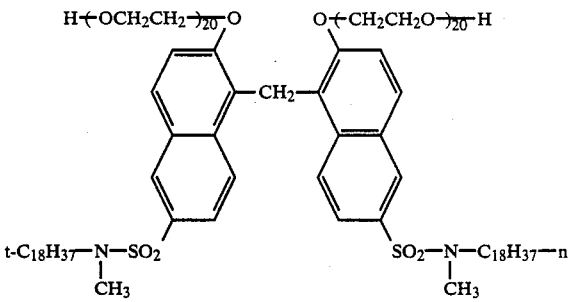

XI-(14)

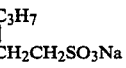

XII-(1)

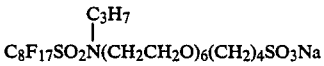

XII-(2)

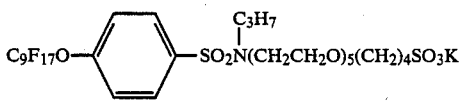

XII-(3)

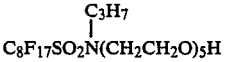

XII-(4)

In the light-sensitive photographic material of the present invention, a betaine type surface active agent disclosed in Japanese Patent O.P.I. Publications No. 104925/1982 and No. 16233/1983 can be further used.

In the light-sensitive photographic material of the present invention, the photographic emulsion layers and other hydrophilic colloid layers may contain an inorganic or organic hardening agent. For example, there can be used, alone or in combination, chromium salts (such as chrome alum and chromium acetate), aldehydes (such as formaldehyde, glyoxal and glutalaldehyde), N-methylol compounds (such as dimetylol urea and methyloldimethylhydantoin), dioxane derivatives (such as 2,3-dihydroxydioxane), active vinyl compounds (such as 1,3,5-triacryloyl-hexahydro-s-triazine and 1,3-vinylsulfonyl-2-propanol), active halogen compounds (such as 2,4-dichloro-6-hydroxy-s-triazine), mucohalogen acids (such as mucochloric acid and mucophenoxychloric acid), etc.

Particularly preferable hardening agents used in the present invention may include aldehydes and the compounds represented by Formulas (XIII), (PI), (PII) and (PIII).

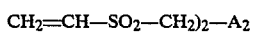

Formula (XIII)

In the formula, $A_2$ represent a divalent group, but may not be present.

Examples of the compound that can be used in the present invention may include the following:

Exemplary Compounds:

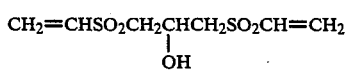

XIII-(1)

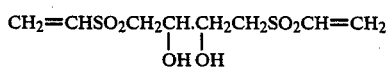

XIII-(2)

-continued $CH_2{=}CH.SO_2CH_2\underset{\underset{OH}{|}}{CH}.\underset{\underset{OH}{|}}{CH}_2CH_2SO_2CH{=}CH_2$ XIII-(3)

$CH_2{=}CH{-}SO_2.CH_2\underset{\underset{OH}{|}}{CH}\underset{\underset{OH}{|}}{CH}\underset{\underset{OH}{|}}{CH}CH_2SO_2CH{=}CH_2$ XIII-(4)

$CH_2{=}CH{-}SO_2CH_2CONH\rangle_2$ XIII-(5)

$CH_2{=}CH.SO_2CH_2CONH\rangle_2CH_2$ XIII-(6)

$CH_2{=}CHSO_2CH_2CONHCH_2\rangle_2$ XIII-(7)

$CH_2{=}CHSO_2CH_2CONHCH_2)_2{-}CH_2$ XIII-(8)

XIII-(9)

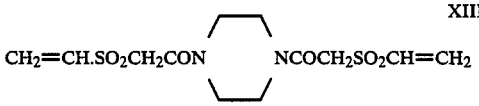

$CH_2{=}CH.SO_2CH_2CON$ $NCOCH_2SO_2CH{=}CH_2$ $CH_2{=}CHSO_2CH_2SO_2CH{=}CH_2$ XIII-(10)

$CH_2{=}CH.SO_2CH_2CH_2SO_2CH{=}CH_2$ XIII-(11)

$CH_2{=}CH.SO_2CH_2CH_2CH_2SO_2CH{=}CH_2$ XIII-(12)

XIII-(13)

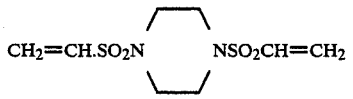

$CH_2{=}CH.SO_2N$ $NSO_2CH{=}CH_2$ $$\left(A_3\right)_x\left(CH_2{-}\underset{\underset{\underset{\underset{SO_2{-}R_{42}}{|}}{L}}{\underset{\underset{Q}{|}}{C}}}{\overset{R_{41}}{|}}\right)_y \quad \text{(PI)}$$

In the formula, $A_3$ represents an ethylenically unsaturated monomer copolymerizable with a monomer unit shown at the right side thereof.

In the formula, also, $R_{41}$ represents a hydrogen atom or a lower alkyl group having 1 to 6 carbon atoms. Q represents any one of —CO2—, $$-CO-\overset{R_{41}}{\overset{|}{N}}-$$

(wherein $R_{41}$ represents the same as defined above) and an arylene group having 6 to 10 carbon atoms.

L represents either a divalent group having 3 to 15 carbon atoms and containing at least oen of —CO2—, $$-CO-\overset{R_{41}}{\overset{|}{N}}-$$

bonds (wherein $R_{41}$ represents the same as defined above), or a divalent group having 1 to 12 carbon atoms and containing at least one of —C—, $$-\overset{R_{41}}{\overset{|}{N}}-,$$

$$-CO-,\ -SO-,\ -SO_2-,\ -SO_3-,$$

$$-SO_2\overset{R_{41}}{\overset{|}{N}}-,\ -\overset{R_{41}}{\overset{|}{N}}CO\overset{R_{41}}{\overset{|}{N}}-,\ -\overset{R_{41}}{\overset{|}{N}}CO_2$$

(wherein $R_{41}$ represents the same as defined above). $R_{42}$ represents a vinyl group or a functional group serving as a precursor thereof, and either $-CH{=}CH_2$ or $-CH_2CH_2X$. X represents a group that can be substituted with a nucleophilic group, or a group eliminable in the form of HX through a base.

In the formula, y represents a mole percentage; x takes a number of 0 to 99; and y, 1 to 100.

Examples of the ethylenically unsaturated monomer represented by $A_3$ in Formula (PI) are ethylene, propylene, 1-butene, isobutene, styrene, chloromethylstyrene, hydroxymethylstyrene, sodium vinylbenzene sulfonate, sodium vinylbenzyl sulfonate, N,N,N-trimethyl-N-vinylbenzyl ammonium chloride, N,N-dimethyl-N-benzyl-N-vinylbenzyl ammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (for example, vinyl acetate and acryl acetate), ethylenically unsaturated monocarboxylic acids or dicarboxylic acids and salts thereof (for example, acrylic acid, methacrylic acid, itaconic acid, maleic acid, sodium acrylate, potassium acrylate, and sodium methacrylate), maleic anhydride, ethylenically unsaturated monocarboxylic acid or dicarboxylic acid esters (for example, n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate, and maleic monobenzyl ester), and ethylenically unsaturated monocarboxylic acid or dicarboxylic acid amides (for example, acrylamide, N,N-dimethyl acrylamide, N-methylol acrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloylpropanediamine propionatobetaine, and N,N-dimethyl-N'-methacryloylpropanediamine acetatobetaine).

Also, when the polymer of the present invention is used as a crosslinked latex, there are at least used as $A_3$, besides the above ethylenically unsaturated monomers, monomers having two or more of copolymerizable ethylenically unsaturated groups (for example, divinylbenzene, methylenebisacrylamide, ethylene glycol diacrylate, trimethylene glycol diacrylate, ethylene glycol dimethacrylate, trimethylene glycol dimethacrylate, neopentyl glycol demethacrylate, etc.).

Examples of $R_{41}$ in Formula (PI) may include a methyl group, an ethyl group, a butyl group and n-hexyl group.

Q may include the groups as shown below.

$$-CO_2-,\ -CONH-,\ -\overset{CH_3}{\overset{|}{C}}ON-,$$

$$-\overset{C_2H_5}{\overset{|}{C}}ON-,\ -\overset{nC_4H_9}{\overset{|}{C}}ON-,$$

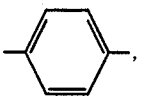

-continued

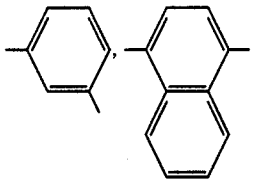

L may include the groups as shown below.

$-CH_2CO_2CH_2-$
$-CH_2CO_2CH_2CH_2-$
$-CH_2CH_2CO_2CH_2CH_2-$
$\text{-}(CH_2)_5CO_2CH_2CH_2-$
$\text{-}(CH_2)_{10}CO_2CH_2CH_2-$
$-CH_2NHCOCH_2-$
$-CH_2NHCOCH_2CH_2-$
$\text{-}(CH_2)_5NHCOCH_2CH_2-$
$-CH_2)_5NHCOCH_2CH_2-$
$\text{-}(CH_2)_{10}NHCOCH_2CH_2-$
$-CH_2OCH_2-$
$-CH_2CH_2OCH_2CH_2CH_2-$ $-\overset{CH_3}{\overset{|}{N}}CH_2CH_2-$ $-CH_2\overset{CH_3}{\overset{|}{N}}CH_2CH_2$ $-COCH_2CH_2-$
$-CH_2COCH_2CH_2-$

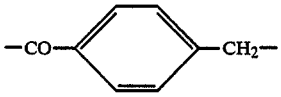

$-SOCH_2CH_2-$
$-CH_2SOCH_2CH_2-$
$-SO_2CH_2CH_2-$
$-SO_2CH_2CH_2SO_2CH_2CH_2-$ $-SO_2CH_2CH_2SO_2CH_2CH\underset{\underset{OH}{|}}{C}H_2-$ $-SO_3CH_2CH_2CH_2-$
$-SO_3CH_2CO_2CH_2CH_2-$
$-SO_3CH_2CH_2CO_2CH_2CH_2-$
$-SO_2NHCH_2CO_2CH_2CH_2-$
$-SO_2NHCH_2CH_2CO_2CH_2CH_2-$
$-NHCONHCH_2CH_2-$
$-CH_2NHCONHCH_2CH_2-$
$-NHCO_2CH_2CH_2-$
$-CH_2NHCO_2CH_2CH_2-$ $R_{42}$ in Formula (PI) may include the groups as shown below.

$-CH=CH_2$, $-CH_2CH_2Cl$, $-CH_2CH_2Br$, $-CH_2CH_2O_3SCH_3$,

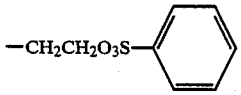

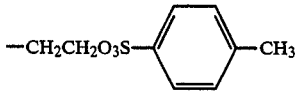

$-CH_2CH_2OH$, $-CH_2CH_2O_2CCH_3$, $-CH_2CH_2O_2CCF_3$, $-CH_2CH_2O_2CCHCl_2$.

Preferable examples of the high molecular hardening agents are disclosed in U.S. Pat. No. 4,161,407, and have a repetitive unit representative by Formula (PII) shown below.

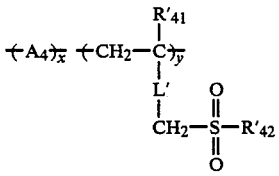

(PII)

In the formula, $A_4$ is an ethylenically unsaturated monomer unit, or a mixture of monomers, copolymerizable with the monomer unit shown at the right side thereof.

In the formula, x and y each represent a percentage, and x takes the value of 0 to 95%, and y, 5 to 90%. $R'_{41}$ represents a hydrogen atom or an alkyl group having 1 to 6 carbon atoms; and $R'_{42}$ represents a group of $-CH=CH_2$ or $-CH_2CH_2X$. X represents a group that can be substituted with a nucleophilic group, or a group eliminable in the form of HX through a base.

L' represents a linking group selected from an alkylene (more preferably an alkylene having 1 to 6 carbon atoms, including, for example, linking group selected from methylene, ethylene, isobutylene, etc.), an arylene having 6 to 12 carbon atoms (for example, a linking group selected from phenylene, tolylene, naphthalene, etc.), and —COZ— or $-COZR_{43}$ (wherein $R_{43}$ is an alkylene having 1 to 6 carbon atoms or an arylene having 6 to 12 carbon atoms; and Z is a hydrogen atom or NH).

Examples of $A_4$ in Formula (PII) may include the same as those of $A_3$ in Formula (PI). Examples of $R'_{41}$ in Formula (PII) may include the same as those of $R_{41}$ in Formula (PI). Examples of $R'_{42}$ in Formula may include the same as those of $R_{42}$ in Formula (PI).

Other preferable high molecular hardening agents may have a repetitive unit represented by Formula (PIII) shown below, as disclosed in British Pat. No. 1,534,455.

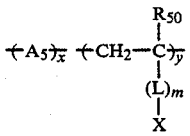

(PIII)

In the formula, $A_5$ represents an ethylenically unsaturated monomer unit copolymerizable with the monomer unit shown at the right side thereof; $R_{50}$ represents a hydrogen atom, or an alkyl group having 1 to 6 carbon atoms; L represents a divalent linking group having 1 to 20 carbon atoms (more preferably a divalent group having 1 to 12 carbon atoms and containing at least one of —CONH— and —CO— bonds); X represents an active ester group; x and y each represent a mole percentage, and x takes the value of 0 to 95, and y, 5 to 100; and m is 0 or 1.

Examples of $A_5$ in Formula (PIII) may include the same as those of $A_3$ in Formula (PI).

$R_{50}$ in Formula (PIII) may include the same as the examples for $R_{41}$ in Formula (PI), which are described in the above.

L in Formula (PII) may include the groups as shown below.

—$CONHCH_2$—, —$CONHCH_2CH_2$—, —$CONHCH_2CH_2CH_2$—, —$CONHCH_2CH_2CH_2CH_2CH_2$—, —$COCH_2CH_2OCOCH_2CH_2$—, —$CONHCH_2CONHCH_2$—, —$CONHCH_2CONHCH_2CONHCH_2$—, —$COCH_2$—, —$CONHCH_2NHCOH_2CH_2SCH_2CH_2$—, —$CONHCH_2OCOCH_2CH_2$—.

X in Formula (PIII) may include the groups as shown below.

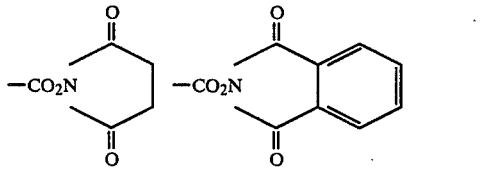

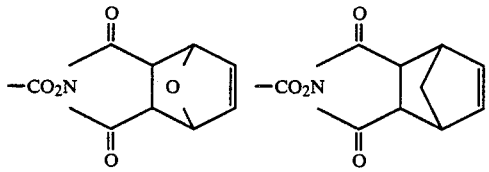

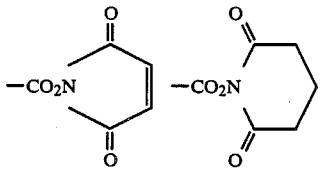

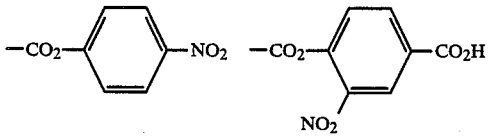

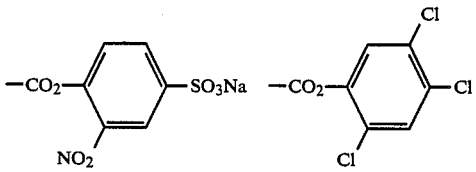

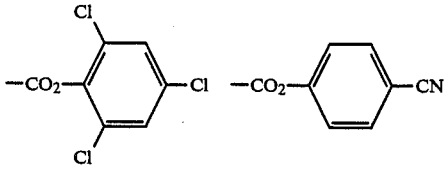

—$CO_2CH_2CN$ —$CO_2CH_2CO_2C_2H_5$

—$CO_2CH_2CONH_2$ —$CO_2CH_2COCH_3$

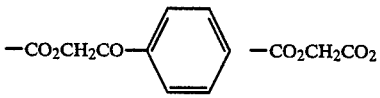

—$CO_2N{=}CHCH_3$ —$CO_2N{=}C(CH_3)_2$

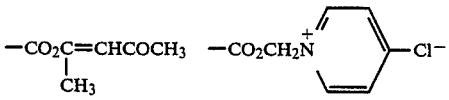

-continued

—$CO_2CH_2CH_2Br$ —$CO_2CH_2CH_2CN$

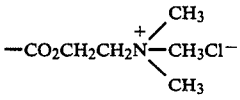

Specific examples of the compounds usable in the present invention are shown below, but by no means limited to these.

P-1

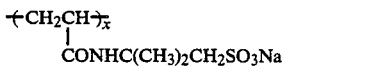

P-2

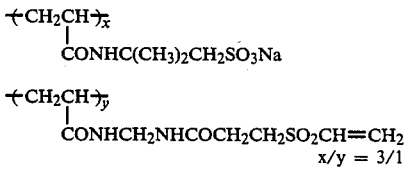

P-3

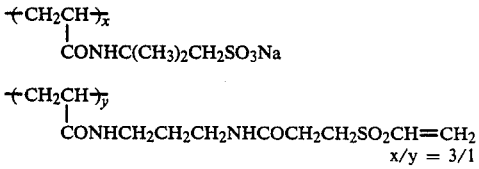

P-4

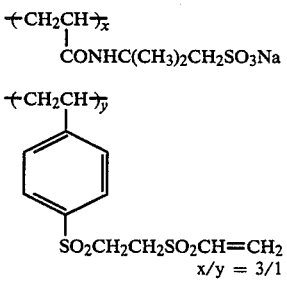

P-5

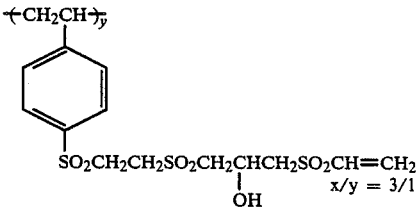

P-6

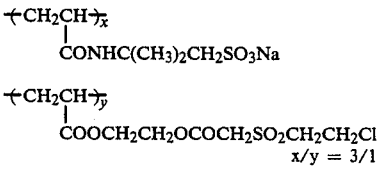

-continued
P-7
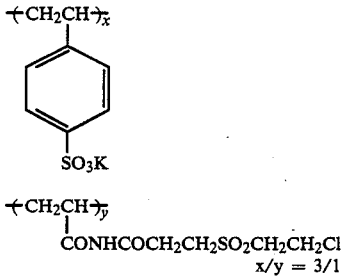
x/y = 3/1
P-8
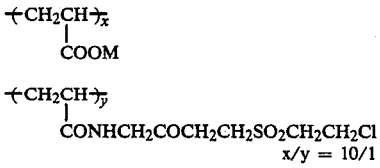
x/y = 10/1
P-9
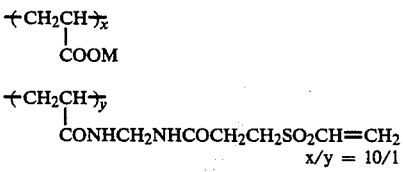
x/y = 10/1
P-10
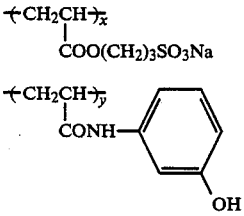
x/y = 3/1
P-11
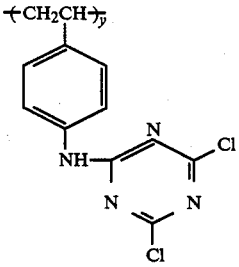
x/y = 20/1
P-12
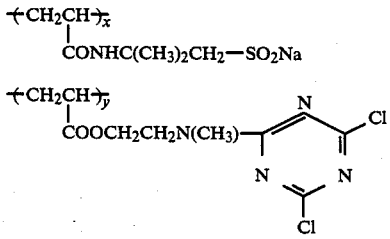
x/y = 5/1
-continued
P-13
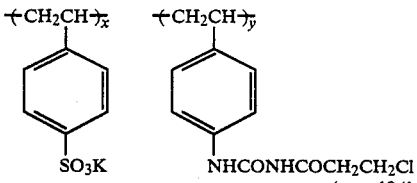
x/y = 10/1
P-14
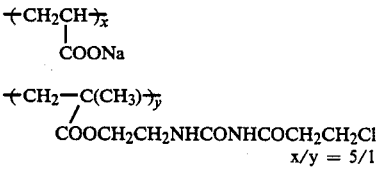
x/y = 5/1
P-15
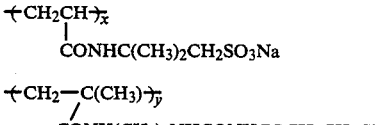
x/y = 10/1
P-16
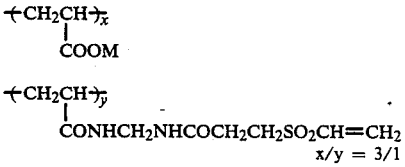
x/y = 3/1
P-17
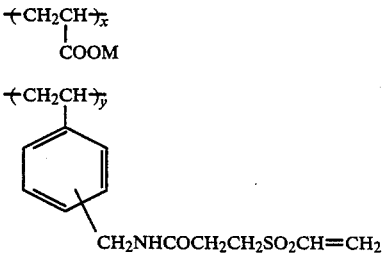
x/y = 3/1
P-18
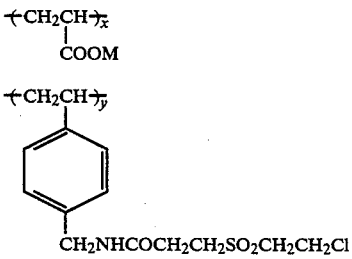
x/y = 3/1
P-19
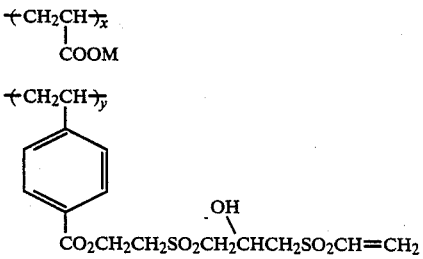
x/y = 3/1

-continued

P-20

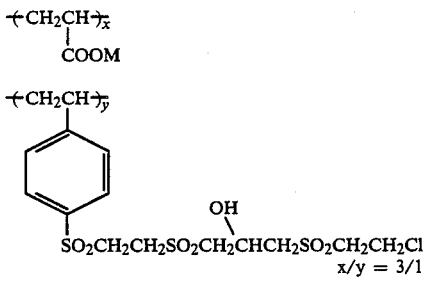

x/y = 3/1

P-21

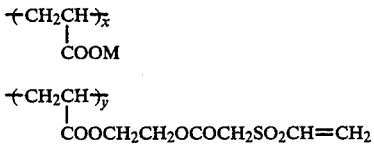

x/y = 3/1

P-22

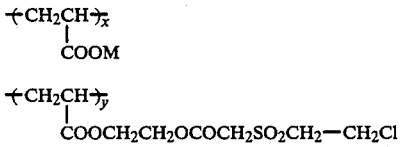

x/y = 3/1

In the above, M is a hydrogen atom, a sodium atom or a potassium atom; x and y each are a mole percentage to show the content of the respective units, which may not be limited to the above, and can take the value of 0 to 99 for x, and 1 to 100 for y.

In the light-sensitive photographic material of the present invention, the photographic emulsion layers and other hydrophilic colloid layers may contain a dispersed product of a water soluble or slightly soluble synthetic polymer for the purpose of improving the dimensional stability. For example, there can be used, solely or in combination, alkyl acrylates or methacrylates, alkoxyalkyl acrylates or methacrylates, glycidyl acrylates or methacrylates, acryl- or methacrylamide, vinyl esters (for example, vinyl acetate), acrylonitriles, olefins, styrenes, etc. or polymers having monomer components comprising the combination of these with acrylic acid, methacrylic acid, $\alpha$, $\beta$-unsaturated dicarboxylic acid, hydroxyalkyl acrylates or methacrylates, sulfoalkyl acrylates or methacrylates, styrenesulfonic acid, etc.

The photographic emulsion used in the present invention may contain the compound represented by General Formula (XIV) shown below, in order to suppress the deterioration of the image quality of a photographic image in a rapid development processing carried out at a high pH and a high temperature.

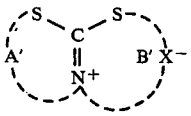

General Formula (XIV)

In the above general formula, A' And B' each represent a group of non-metallic atoms necessary for the formation of a heterocyclic ring; and X represents an anion (for example, $Cl^-$, $Br^-$, $ClO^-$, $CH_3SO_3^-$, etc.).

First, referring to Compound (XIV), desirable is a compound wherein the group A and/or B of non-metallic atoms necessary for the formation of a heterocyclic ring of the compound represented by Compound (XIV) is represented by a group of

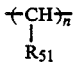

(wherein $R_{51}$ represents a hydrogen atom or a lower alkyl group; and n represents 2 or 3). Typical examples of Compound (XIV) may include the compounds shown below.

(XIV-1)

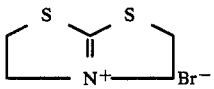

(XIV-2)

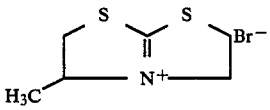

(XIV-3)

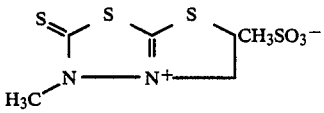

(XIV-4)

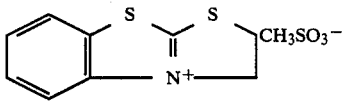

(XIV-5)

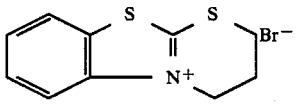

(XIV-6)

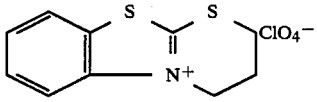

(XIV-7)

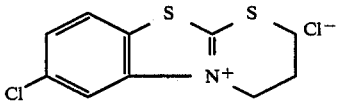

In the light-sensitive material of the present invention, the hydrophlic colloid layers may contain a water soluble dye as a filter dye or for the purpose of preventing the irradiation and other various purposes. Such a dye may include oxonol dyes, hemioxonol dyes, styryl dyes, merocyanine dyes, cyanine dyes and azo dyes. Among these, oxonol dyes, hemioxonol dyes and merocyanine dyes are useful.

The photographic emulsion used in the present invention may contain a magenta and/or yellow filter dyes. Substances preferably usable in the present invention may be exemplified by those set forth below.

a.
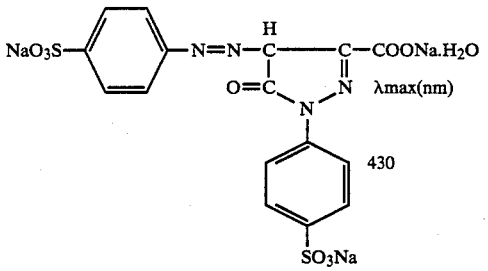
b.
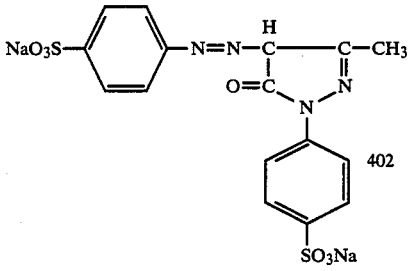
c.
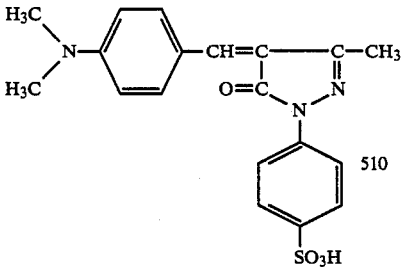
d.
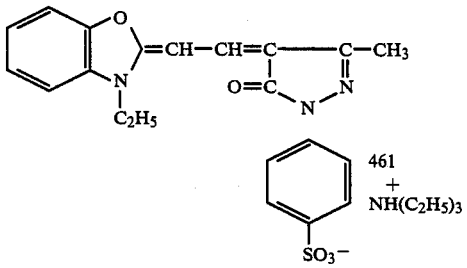
e.
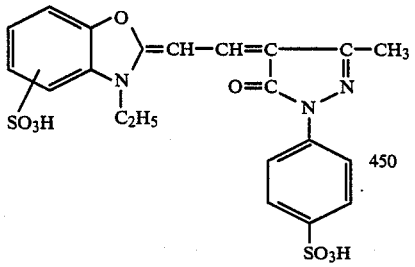
f.
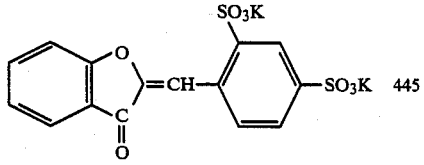

-continued
g.
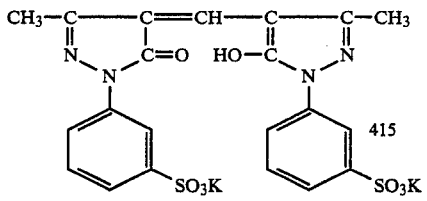
415
h.
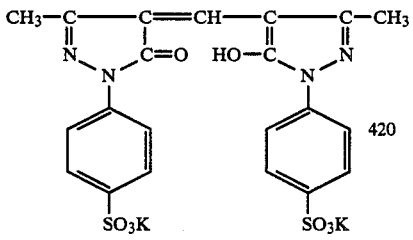
420
i.
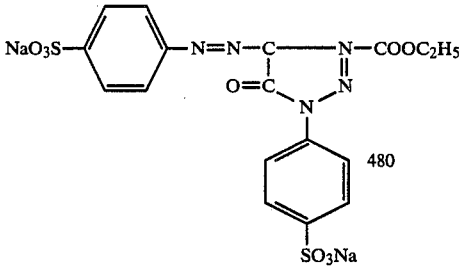
480
j.
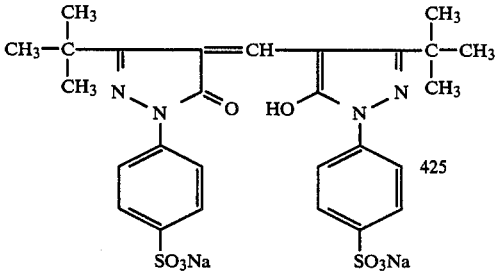
425
k.
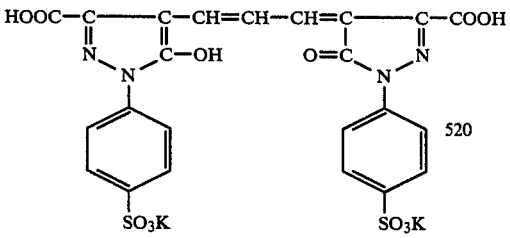
520
l.
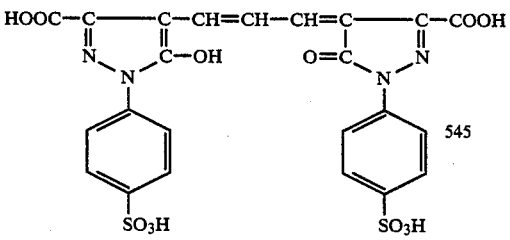
545

-continued m.

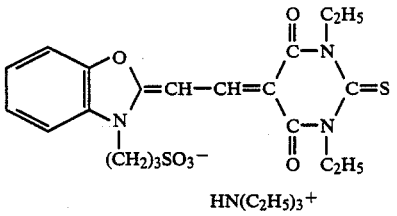

459 n.

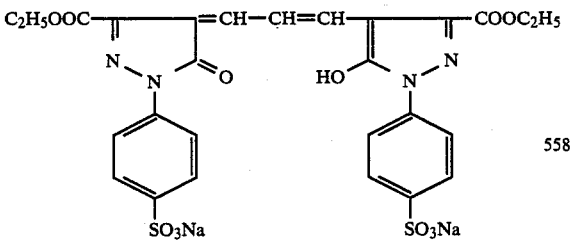

558 o.

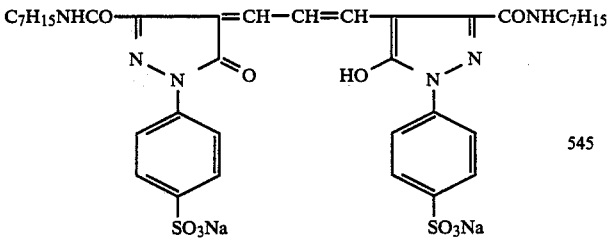

545 p.

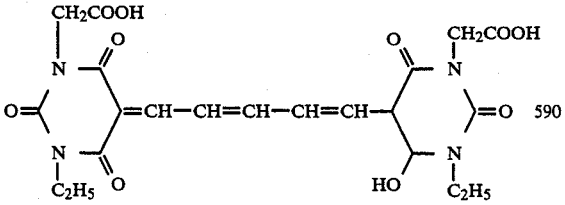

590 q.

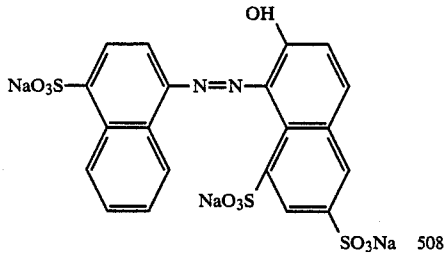

508

Any of dyes can be selected from the above dye compounds according to what they are used for, but particularly preferable compounds may include those having the structure included in General Formula (A) shown below.

General Formula (A)

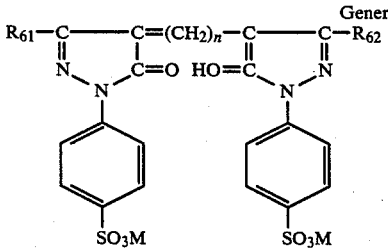

In the formula, $R_{61}$ and $R_{62}$ each represents an alkyl group having 1 to 7 carbon atoms, a carboxyl group, an alkoxycarbonyl group, an alkylaminocarbonyl group, an amino group, an acylamino group or a trifluoromethyl group; M represents a hydrogen atom, an alkali metal atom or an ammonium group; and n is 1 or 3.

Further, in the present invention, it is preferable for the emulsion to contain 35% or more of grains of 0.7 μm or less in order to intercept the irradiation light. Particularly preferably, it is desired to contain 50% or more of the same.

In the light-sensitive material of the present invention, when the hydrophilic colloid layers contain dyes or ultraviolet absorbents, they may be mordanted by use of a cationic polymer or the like.

Also, the light-sensitive photographic material of the present invention, the photographic layers may contain an alkyl acrylate type latex disclosed in U.S. Pat. Nos.

3,411,911 and 3,411,912, Japanese Patent Examined Publication No. 5331/1979, etc.

To the silver halide photographic emulsion layer, compounds particularly useful for photographic emulsions can be added, which are, for example, a lubricant, a sensitizing agent, a light absorbing dye, a plasticizer, etc.

The photographic emulsion of the present invention may contain a color image-forming coupler, i.e., a compound capable of forming a dye by reacting with an oxidized product of an aromatic amine (usually, a primary amine) developing agent (hereinafter simply called as coupler). The coupler is preferably a non-diffusible coupler having a hydrophobic group called a ballast group. The coupler may be either of four equivalent type or two equivalent type against silver ion. There may be also contained a colored coupler having a color correcting effect or a coupler capable of releasing a development restrainer as the development proceeds (the so-called DIR compound). The coupler may be such a coupler that forms a colorless product by the coupling reaction.

There can be used a variety of open chain ketomethylene type couplers as yellow color developing couplers. Among them, advantageous are benzoylacetoanilide type compounds and pivaloyl acetoanilide type compounds.

As magenta couplers, pyrazolone compounds, indazolone type compounds, cyanoacetyl compounds and so forth can be used, and, in particular, advantageous are pyrazolone type compounds.

As cyan couplers, phenol type compounds, naphthol type compounds and so forth can be used.

Protective layer of the light-sensitive silver halide photographic material of the present invention is a layer comprising a hydrophilic colloid, and, as the hydrophilic colloid to be used, there can be used those mentioned before. Also, the protective layer may comprise either a single layer or overlapped layers.

A matte agent and/or a smoothing agent or the like may be added to the emulsion layers or the protective layers, preferably to the protective layers, of the light-sensitive silver halide photographic material of the present invention. Examples of the matte agent preferably used may include organic compounds such as water dispersible vinyl polymers including polymethyl methacrylate having suitable grain size (preferably, grain size of 0.3 to 5$\mu$, or twice or more, particularly four times or more, of the thickness of a protective layer), or inorganic compounds such as silver halide and strontium sulfate or barium sulfate. The smoothing agent is useful for preventing an adhesion trouble as being similar to the matte agent, and also effective for improving the friction characteristics having a relation to the adaptability to cameras when taking photographs of motion picture films or projecting motion pictures. Specific examples thereof that can be preferably used may include waxes such as liquid paraffin and high aliphatic acid esters; fluorinated hydrocarbons or derivatives thereof; and silicones such as polyalkyl polysiloxane, polyaryl polysiloxane, polyalkylaryl polysiloxane or alkylene oxide addition derivatives of these.

In addition, if necessary, the light-sensitive silver halide photographic material of the present invention can be provided with an anithalation layer, an intermediate layer, a filter layer and the like.

The light-sensitive silver halide photographic material of the present invention can be applied, for example, in X-ray sensitive materials, lithographic light-sensitive materials, color reversal light-sensitive materials, color photographic papers, etc.

If necessary, other additives can be used in the light-sensitive photographic material of the present invention. For example, they include a dye, a development accelerator, a brightening agent, a color fog preventive agent, an ultraviolet absorbent, etc. Specifically, there can be used those disclosed in Research Disclosure No. 176, pp. 28–30 (RD-17643, 1978).

In the light-sensitive photographic material of the present invention, the photographic emulsion layers or other layers are applied to one side or both sides of a flexible support usually used in light-sensitive materials. Useful as the flexible support are films comprising semi-synthesized or synthesized macromolecules such as cellulose nitrate, cellulose acetate, cellulose acetate butylate, polystyrene, polyvinyl chloride, polyethylene terephthalate, polycarbonate, etc.; paper coated or laminated with a baryta layer or an $\alpha$-olefin polymer (for example, polyethylene, polypropylene, an ethylene/butene copolymer), etc. The support may be colored by using a dye or a pigment. It may be made brilliant for the purpose of light interception. The surface of these supports are, in general, subbing-treated in order to improve the adhesion with a photographic emulsion. Preferable supports are those having been subjected to the subbing treatment disclosed in Japanese Patent O.P.I. Publications No. 104193/1977, No. 18949/1984, No. 19940/1984 or No. 19941/1984. The surface of tbe support may be applied with corona discharge, ultaviolet irradiation, flame treatment, etc. before or after the subbing treatment.

In the light-sensitive photographic material of the present invention, the photographic emulsion layers or other hydrophilic colloid layers can be applied on a support or other layers according to various coating methods. In coating, a dip coating method, a roller coating method, a curtain coating method, an extrusion coating method, etc. can be employed.

The present invention can be used in any light-sensitive photographic materials if they require the high sensitivity or the high contrast. For example, they may be used in the X-ray sensitive materials, the lithographic light-sensitive materials and the color photographic papers as mentioned in the above.

It can be also used in diffusion transfer light-sensitive materials, color diffusion transfer light-sensitive materials, etc. by dissolving an undeveloped silver halide so as to be deposited on an image-receiving layer adjacent to a silver halide emulsion layer.

Any of the known methods and known processing solutions as disclosed in Research Disclosure No. 176, pp. 28 to 30 (RD-17643) can be used in the photographic processing of the light-sensitive material of the present invention. This photographic processing may be either photographic processing for the formation of silver images (i.e., black and white photographic processing) or photographic processing for the formation of color images (i.e., color photographic processing). The processing temperature may be selected in the range between 18° C. to 50° C. in usual cases, but may be made lower than 18° C. or higher than 50° C.

A developing solution to be used when, for example, carrying out a black and white processing may contain various developing agents. There can be used as the developing agents, solely or in combination, dihydroxybenzenes (for example, hydroquinone), 3-pyrazolidones (for example, 1-phenyl-3-pyrazolidone), aminophenols (for example, N-methyl-n-aminophenol), etc. In the photographic processing of the light-sensitive material of the present invention, the processing can be carried out by using the developing solution containing imidazoles as a silver halide solvent, as disclosed in Japanese Patent O.P.I. Publication No. 155489/1980. The processing can also be carried out by using the developing solution containing a silver halide solvent and an additive such as indazole or triazole, as disclosed in Japanese Patent O.P.I. Publication No. 136267/1981. In general, besides these, the developing solution may contain a preservative, an alkali agent, a pH buffering agent, an antifoggant, etc., and may further contain, if necessary, a dissolution auxiliary, a color toning agent, a development accelerator, a surface active agent, an antifoaming agent, a hard water-softening agent, a hardening agent, a viscosity-imparting agent, etc.

In the photographic emulsion of the present invention, the so-called "lith type" developing processing can be applied. The "lith type" developing processing refers to the developing processing wherein the developing procedure is infectiously carried out by usually using dihydroxybenzenes as a developing agent and under a low sulfate ion concentration, to achieve the photographic reproduction of a line image or the photographic reproduction of a half tone image by micro dots. (Details are available from L. F. A. Mason, Photographic Processing Chemistry (1966), pp. 163–165.)

As a special developing processing system, there may be employed a method in which a development agent is incorporated in a light-sensitive material, for example, in emulsion layers, and the light-sensitive material is processed in an aqueous alkali solution to carry out the development. Of the development agent, a hydrophobic development agent can be incorporated in the emulsion layers according to various methods as disclosed in Research Disclosure No. 169 (RD-16928), U.S. Pat. No. 2,739,890, British Pat. No. 813,253 and West German Pat. No. 15 47 763. Such a developing processing may be combined with a silver salt stabilizing processing carried out by using thiocyanate.

As a fixing solution, those having the formulation generally employed can be used. As a fixing agent, there can be used thiosulfate and thiocyanate, as well as organic sulfur compounds known to be effective as fixing agents. The fixing solution may contain a water soluble aluminum salt as a hardening agent.

When a color photographic developing processing is carried out, a negative-positive method, a color reversal method, a silver dye bleaching method, etc. may be employed.

In general, a color developing solution may comprise an alkaline aqueous solution containing a color development agent. The color development solution that can be used may include a variety of primary aromatic amine developing agents such as phenylenediamines (for example, 4-amino-N,N-diethylamine, 3-methyl-4-amino-N,N-diethylaniline, 4-amino-N-ethyl-N-β-hydroxyethylaniline, 3-methyl-α-amino-N-ethyl-N-β-hydroxyethylaniline, 3-methyl-4-amino-N-ethyl-N-β-methanesulfonamide ethylaniline, 4-amino-3-methyl-N-ethyl-N-β-methoxyethylaniline, etc.).

Besides these, those disclosed in L. F. A. Mason, Photographic Processing Chemistry, Focal Press (1966), pp. 226–227, U.S. Pat. Nos. 2,193,015 and No. 2,592,364, Japanese Patent O.P.I. Publication No. 64933/1970.

The color developing solution may further contain a pH buffering agent, a development restrainer or an antifoggant, and so forth. If necessary, it may also contain a hard water softening agent, a preservative, an organic solvent, a development accelerator, a color dye-forming coupler, a competing coupler, a fogging agent, an auxiliary developement agent, a viscosity imparting agent, a polycarboxylic acid type chelating agent, an antioxidant, etc.

After the color development, the photographic emulsion layers are usually subjected to a bleaching processing. The bleaching processing may be carried out simultaneously with a fixing processing, or may be carried out separately. As a bleaching agent, there may be used polyvalent metal compounds such as iron (III), cobalt (IV), chrome (VI) and chrome (III), peracids, quinones, nitroso compounds, etc.

To a bleaching or bleach-fixing solution, there can be added the bleach accelerator disclosed in U.S. Pat. Nos. 3,042,520 and 3,241,966, Japanese Patent O.P.I. Publication No. 8506/1970 and Japanese Patent O.P.I. Publication No. 8836/1970, etc., the thioether compound disclosed in Japanese Patent O.P.I. Publication No. 65732/1978, and other various additives as well.

Exposure for the photographic emulsion may be carried out, though variable depending on the state of optical sensitization and the use purpose, by using various kinds of light sources such as a tungsten lamp, a fluorescent lamp, a mercury lamp, an arc lamp, a xenon lamp, sunlight, xenon flash, a cathode ray tube flying spot, laser beams, electron rays, X-rays, a fluorescent screen used in X-ray photographing. As for the exposure time, there can be applied ordinary exposure for 1/100 to 100 seconds, as well as short time exposure for $1/10^4$ to $1/10^9$ second when xenon flash, cathode ray tube light or laser beam is used.

Examples of the present invention will be described below. The following Examples are to illustrate the present invention, which, however, is by no means limited to these as a matter of course.

EXAMPLE 1

Solutions A to D were prepared according to the following recipe.

| | | |
|---|---|---|
| Solution A: | | |
| Gelatin | 3.0 | g |
| KI | 1.2 | g |
| $H_2O$ | 200.0 | cc |
| Solution B: | | |
| $AgNO_3$ | 60.0 | g |
| $H_2O$ | 138.7 | cc |
| $NH_4OH$ | 47.5 | cc |
| Solution C: | | |
| Gelatin | 2.0 | g |
| 56% glacial acetic acid | 8.0 | cc |
| KBr | 50.0 | g |
| $H_2O$ | 112.6 | cc |
| Solution D: | | |
| KI | 0.3 | g |
| $H_2O$ | 10.0 | cc |

Solution A was introduced in a vessel kept at 56° C., and Solution B kept at 40° C. was added thereto with stirring, at the flow rate of 4 cc/min over a period of 1 minute. After the addition, the mixture was stirred for 2 minutes, and thereafter Solution C kept at 40° C. and Solution B kept at 40° C. were added at the flow rate of 11 cc/min over a period of 12 minutes and at the flow rate of 7.3 cc/min over a period of 27 minutes, respectively. Further, 8 minutes after initiating the addition of Solutions B and C, Solution D in whole amount was added over a period of 1 minute and 30 seconds. One minute after termination of the addition of Solution C, a 56% glacial acetic acid solution was added over a period of 11 minutes until the mixture was made to be pH 6.20. Silver halide grains of the resulting emulsion were poly dispersed twin crystls having iodine content of 2.5 mole % and had an average grain size of 1,000μ.

Also, two kinds of emulsions were prepared by varying the position of addition of Solution D so as to be 2 minute after the initiation of the addition of Solutions B and C, and 14 minutes after the same. Other procedures were unchanged. The resulting grain size was about 1,000μ in both emulsions.

The above three kinds of silver halide emulsions were desalted to remove an excessive salt, and were applied with chemical ripening. The chemical ripening was carried out by adding $5.0\times10^{-7}$ mole of chloroauric acid, $2.3\times10^{-3}$ mole of potassium thiocyanate and $4.8\times10^{-6}$ mole of sodium thiosulfate per 1 mole of silver, and at 54° C. for 80 minutes, followed by addition of 4-hydroxy-6-methyl-1,3,3a,7-tetrazaindene, and after termination of the chemical ripening, a coating aid was added to coat polyethylene terephthalate bases with the emulsions to have a coating amount of 60 mg/dm$^2$ each.

These samples using the grains of the present invention were designated as Samples No. I-1, -2 and -3 respectively in the order of the Solution D addition time made to be 8 minutes, 2 minutes and 14 minutes after the initiation of the addition of Solutions B and C.

The following two kinds of emulsions were produced as comparative examples.

That is, KI contained in Solution D was added to Solution A to prepare, without adding Solution D, a silver halide emulsion having an average grain size of 1,000μ and an iodine content of 2.5 mole %. Procedures for the desalting step and subsequent steps were same as those for Sample No. I. The resulting sample was designated as Sample No. II.

| | |
|---|---|
| Solution A': | |
| Gelatin | 3.0 g |
| KBr | 0.8 g |
| $H_2O$ | 200.0 cc |
| Solution B': | |
| $AgNO_3$ | 60 g |
| $NH_4OH$ | 47.0 cc |
| $H_2O$ | 140.0 cc |
| Solution C': | |
| Gelatin | 20.0 g |
| KBr | 48.2 g |
| KI | 1.2 g |
| $H_2O$ | 111.0 cc |
| Solution D': | |
| KI | 0.3 g |
| $H_2O$ | 10.0 cc |

The above Solutions A' to D' were produced according to the same procedures as those for Sample No. I. This was designated as Sample No. III.

Coated samples thus obtained were humidity-controlled to a relative humidity of 30% at 23° C., and thereafter folded by about 180° C. with a curvature radius of 2 cm. After 3 minutes, the samples were exposed using an optical wedge for $10^{-2}$ second with use of a tungsten lamp as a light source. Further, using Developing Solution XD-90 produced by Konishiroku Photo Industry Co., Ltd., development was carried out at 35° C. for 30 minutes, followed by fixing and drying.

The density difference between the desensitized portions resulted by folding at several points of from 0.5 to 1.5 and the portions where no folding was made was assumed to be ΔD, and each density D was divided by ΔD to give an average value $\overline{\Delta D/D}$. This value was used as a criterion of the desensitization due to the folding. Namely, it follows that the desensitization due to the pressure applied by the folding is smaller as the smaller value is given.

Further, under the same humidity controlling conditions and the folding conditions as mentioned above, same treatments were carried out without exposure, to read the density ΔD at the portions of the pressure marks appeared on the folded potions.

Results obtained are summarized below in Table 1.

TABLE 1

| Sample No. | ΔD/D | ΔD | Remarks |
|---|---|---|---|
| I-1 | 0.03 | 0.03 | Present invention |
| I-2 | 0.00 | 0.06 | Present invention |
| I-3 | 0.05 | 0.01 | Present invention |
| II | 0.08 | 0.08 | Comparative ex. |
| III | 0.11 | 0.14 | Comparative ex. |

As is clear from Table 1, the pressure resistance is clearly excellent in the present invention. Also, within the scope of the present invention, the pressure resistance is found to vary according to the position of the addition of KI, showing that Sample No. I shows good results for both the pressure desensitization and the pressure marks.

EXAMPLE 2

Using the respective emulsions obtained in Example 1 and having been subjected to chemical ripening, triacetyl cellulose film supports having been subbing-processed were coated with emulsions and protective layers to have the coating amount as shown below.

(1) Emulsion Layer:

Emulsion (Silver $4.2\times10^{-2}$ mole/m$^2$)

Coupler ($1.5\times10^{-3}$)

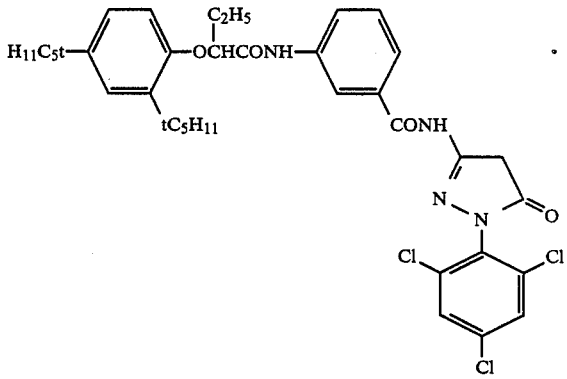

Dye

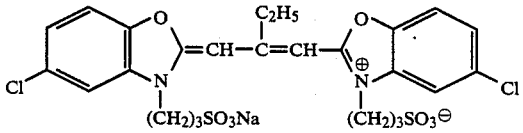

-continued

| | |
|---|---|
| Tricrezyl phosphate | (1.10 g/m$^2$) |
| Gelatin | (2.30 g/m$^2$) |
| (2) Protective layer: | |
| 2,4-dichlorotriazine-6-hydroxy-s-triazine sodium salt | (0.08 g/m$^2$) |
| Gelatin | (1.80 g/m$^2$) |

These samples were allowed to stand for 14 hours under the conditions of 40° C. and a relative humidity of 70%, and thereafter subjected to exposure for a sensitometry to carry out the developing processing shown below.

Measurement of the density was carried out on the thus processed samples with use of a green filter. The developing processing employed here was carried out at 38° C. under the following conditions:

| | |
|---|---|
| 1. Color development | 2 minutes 45 seconds |
| 2. Bleaching | 6 minutes 30 seconds |
| 3. Washing with water | 3 minutes 15 seconds |
| 4. Fixing | 6 minutes 30 seconds |
| 5. Washing with water | 3 minutes 15 seconds |
| 6. Stabilizing | 3 minutes 15 seconds |

The processing solutions used in the respective steps had the following formulation.

| | |
|---|---|
| Color developing solution: | |
| Sodium nitrotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methyl-aniline sulfate | 4.5 g |
| Made up to 1 liter by adding water. | |
| Bleaching solution: | |
| Ammonium bromide | 160.0 g |
| Ammonia water (28%) | 25.0 ml |
| Ethylenediaminetetraacetic acid sodium iron salt | 130 g |
| Glacial acetic acid | 14 ml |
| Made up to 1 liter by adding water. | |
| Fixing solution: | |
| Sodium tetrapolyphosphate | 3.0 g |
| Sodium sulfite | 4.0 g |
| Ammonium thiosulfate (70%) | 175.0 ml |
| Sodium bisulfite | 46 g |
| Made up to 1 liter by adding water. | |
| Stabilizing solution | |
| Formalin | 5.0 ml |
| Made up to 1 liter by adding water. | |

Under the same conditions as in Example 1, pressure marks were further observed. Results obtained are shown in Table 2.

TABLE 2

| Sample No. | Sensitivity | ΔD | Remarks |
|---|---|---|---|
| I-1 | 98 | 0.02 | Present invention |
| -2 | 98 | 0.06 | Present invention |
| -3 | 100 | 0.01 | Present invention |
| II | 90 | 0.09 | Comparative ex. |
| III | 76 | 0.11 | Comparative ex. |

(Sensitivity refers to a relative sensitivity assuming that of No. I-3 as 100.)

EXAMPLE 3

A silver halide emulsion having an average grain size of 1.45 μm was obtained according to the same method for the preparation of the emulsion of Sample No. I-1 used in Example 1, except that only the temperature in the reaction system was changed to be 60° C. After subjecting it to desalting and chemical sensitization, a coating aid was added to coat a polyethylene terephthalate base with the emulsion to give 50 mg/dm$^2$. This was designated as Sample No. I-4.

Two kinds of emulsions shown below were further produced as comparative samples. Namely;

| | |
|---|---|
| Solution E: | |
| $H_2O$ | 958 cc |
| Gelatin | 30 g |
| KBr | 0.4 g |
| 25% Ammonia water | 30.0 cc |
| Solution F: | |
| $H_2O$ | 943 cc |
| $AgNO_3$ | 250 g |
| Solution G: | |
| $H_2O$ | 935 cc |
| KBr | 180 g |
| Solution H: | |
| $H_2O$ | 200 cc |
| KI | 0.2 g |

The above Solution E was introduced with stirring in a vessel kept at 50° C., and Solution F and Solution G in amount of 13 cc each were simultaneously added thereto. Based on 187 cc of Solution F, Solution B was simultaneously added while keeping pBr=2.44. Subsequently, Solution H was added with stirring over a period of 20 minutes. Again, Solution F was added while keeping pBr=2.44, to obtain an emulsion of monodispersed cubic grains of 1.45 μm grain size. After carrying out desalting and chemical sensitization, a coating aid was added to coat a polyethylene terephthalate base with the emulsion to have a coating amount of 50 mg/dm$^2$. (Sample No. IV)

| | |
|---|---|
| Solution I: | |
| $H_2O$ | 970 cc |
| Gelatin | 30 g |
| KBr | 8 g |
| Methanol solution of 1% 3,4-dimethyl-4-thiazoline-2-thion | 80 cc |
| Solution J: | |
| $H_2O$ | 943 cc |
| $AgNO_3$ | 250 g |
| Solution K: | |
| $H_2O$ | 925 cc |
| KI | 5 g |
| KBr | 206 g |

Solution I was introduced with stirring in a vessel kept at 75° C., and Solution J and Solution K were simultaneously added over a period of 60 minutes while keeping pBr=1.41. A 1% KI solution was added over a period of 10 minutes so as to feed KI in amount of 1 g per 0.2 mole of silver nitrate used. Further, a mixed solution comprising 790 cc of water, 15 g of gelatin and 80 cc of a methanol solution of 1% 3,4-dimethyl-4-thiazoline-2-thion was added, and a solution of 0.64N $AgNO_3$ and a solution of 1.09N KBr were further added while keeping pH=1.41. In this manner, an emulsion of monodispersed octahedral grains having a grain size of 1.45μ was obtained. After carrying out desalting and chemical sensitization, a coating aid was added to coat a PET base with the emulsion to have a coating amount of 50 mg/dm$^2$. (Sample No. V)

On these three kinds of samples, the pressure resistance was examined in the same procedures as in Example 1. Results obtained are shown in Table 3.

TABLE 3

| Sample No. | ΔD/D | ΔD | Remarks |
|---|---|---|---|
| I-4 | 0.03 | 0.03 | Present invention |
| IV | 0.09 | 0.10 | Comparative ex. |
| V | 0.11 | 0.10 | Comparative ex. |

The pressure resistance is seen to be excellent in Sample I-1 of the present invention.

EXAMPLE 4

After adding Solution C to the emulsion of Sample No. I-1 used in Example 1, hexachloroiridium (VI) potassium salt in amount of $8.8\times10^{-8}$ mole per 1 mole of silver was dissolved in 20 cc of a 25% NaCl solution, and added over a period of 15 seconds. Thereafter, 1 minute later, a 56% glacial acetic acid solution was added, followed by the desalting, the chemical ripening and the coating in the same manners as for Sample No. I-1. The resulting sample was designated as I-5. The pressure resistance was examined in the same manner as in Example 1. Results obtained are shown in Table 4.

TABLE 4

| Sample No. | ΔD/D | ΔD | Remarks |
|---|---|---|---|
| I-5 | 0.00 | 0.02 | Present invention |
| I-1 | 0.03 | 0.03 | Present invention |

It is seen that the effect of the present invention is further increased by using iridium salt in the present invention.

As described in the foregoing, the present invention can provide a light-sensitive silver halide photographic material having high sensitivity and also suffering less pressure marks or pressure desensitization, and a silver halide emulsion which can give such a light-sensitive material and a process for producing the same.

What is claimed is:

1. A light-sensitive silver halide photographic emulsion comprising silver halide crystals formed by a process which comprises preparing a dispersion containing homogeneously dispersed silver halide particles, said particles containing silver iodide and having an average grain size of 0.5 μm or less, adding an aqueous solution containing at least one halide other than iodide, and an aqueous solution containing a silver salt to the dispersion, thereby effecting crystal growth, and adding an aqueous solution containing iodide during the course of said crystal growth independent of the addition of said solution containing said halide other than iodide.

2. The light-sensitive silver halide photographic emulsion of claim 1 wherein the addition of said aqueous solution containing said halide other than iodide and said aqueous solution containing silver salt is initiated and effected simultaneously, and the addition of said aqueous solution containing iodide is initiated between two minutes after the initiation of said addition of the water soluble halide and the water soluble silver salt and the termination thereof.

3. A method for preparing a light-sensitive photographic material, said method comprising preparing a dispersion containing homogeneously dispersed silver halide particles, said particles containing silver iodide and having an average grain size of 0.5 μm or less, adding an aqueous solution containing at least one halide other than iodide and an aqueous solution containing a silver salt to said dispersion, thereby effecting crystal growth, and adding an aqueous solution containing iodide during the course of said crystal growth, independent of the addition of said solution containing said halide other than iodide.

4. The method of claim 3 wherein the addition of said aqueous solution containing said halide other than iodide and said aqueous solution containing silver salt is initiated and effected simultaneously, and the addition of said aqueous solution containing iodide is initiated between two minutes after the initiation of said addition of the water soluble halide and the water soluble silver salt, and the termination thereof.

5. A light-sensitive silver halide photographic material comprising a support and, provided thereon, at least one emulsion layer containing silver halide crystals obtained by a process which comprises preparing a dispersion containing homogeneously dispersed silver halide particles, said particles containing silver iodide and having an average grain size of 0.5 μm or less, adding an aqueous solution containing at least one halide other than iodide, and an aqueous solution containing silver salt to said dispersion, thereby affecting crystal growth, and adding an aqueous solution containing iodide during the course of said crystal growth, independent of the addition of said solution containing said halide other than iodide.

6. The light-sensitive silver halide photographic emulsion of claim 1, wherein said crystal growth is effected under pH condition of not less than 7.

7. The light-sensitive silver halide photographic emulsion of claim 1, wherein said crystal growth is effected under pH condition ranging from 8 to 11.

8. The light-sensitive silver halide photographic emulsion of claim 1, wherein said crystal growth is effected under pAg condition ranging from 9.5 to 11.5.

9. The light-sensitive silver halide photographic emulsion of claim 1, wherein said crystal growth is effected under temperature condition of 40° to 60° C.

10. The light-sensitive silver halide photographic emulsion of claim 8, wherein said crystal growth is effected under temperature condition of 40° to 60° C.

11. The light-sensitive silver halide photographic emulsion of claim 9, wherein said crystal growth is effected under temperature condition ranging from 50° to 60° C.

12. The light-sensitive silver halide photgraphic emulsion of claim 11, wherein said crystal growth is effected under temperature condition ranging from 50° to 60° C.

13. The light-sensitive silver halide photographic emulsion of claim 1, wherein amount of addition of said aqueous solution containing iodide is 0.001 to 40 mole % in terms of iodide ion with respect to the silver halide at the time of termination of the crystal growth.

14. The light-sensitive silver halide photographic emulsion of claim 13, wherein amount of addition of said aqueous solution containing iodide is 0.01 to 5 mole % in terms of iodide ion with respect to the silver halide at the time of termination of the crystal growth.

15. The method of claim 3, wherein said crystal growth is effected under pH condition of not less than 7.

16. The method of claim 3, wherein said crystal growth is effected under pH condition ranging from 8 to 11.

17. The method of claim 3, wherein said crystal growth is effected under pAg condition ranging from 9.5 to 11.5.

18. The method of claim 3, wherein said crystal growth is effected under temperature condition of 40° to 60° C.

19. The method of claim 17, wherein said crystal growth is effected under temperature condition of 40° to 60° C.

20. The method of claim 18, wherein said crystal growth is effected under temperature condition ranging from 50° to 60° C.

21. The method of claim 20, wherein said crystal growth is effected under temperature condition ranging from 50° to 60° C.

22. The method of claim 3, wherein amount of addition of said aqueous solution containing iodide is 0.001 to 40 mole % in terms of iodide ion with respect to the silver halide at the time of termination of the crystal growth.

23. The method of claim 22, wherein amount of addition of said aqueous solution containing iodide is 0.01 to 5 mole % in terms of iodide ion with respect to the silver halide at the time of termination of the crystal growth.

24. The light-sensitive silver halide photographic emulsion of claim 6, wherein said crystal growth is effected under pAg condition ranging from 9.5 to 11.5.

25. The light-sensitive silver halide photographic emulsion of claim 7, wherein said crystal growth is effected under pAg condition ranging from 9.5 to 11.5.

26. The light-sensitive silver halide photographic emulsion of claim 6, wherein said crystal growth is effected under temperature condition of 40° to 60° C.

27. The light-sensitive silver halide photographic emulsion of claim 7, wherein said crystal growth is effected under temperature condition of 40° to 60° C.

28. The method of claim 15, wherein said crystal growth is effected under pAg condition ranging from 9.5 to 11.5.

29. The method of claim 16, wherein said crystal growth is effected under pAg condition ranging from 9.5 to 11.5.

30. The method of claim 15, wherein said crystal growth is effected under temperature condition of 40° to 60° C.

31. The method of claim 16, wherein said crystal growth is effected under temperature condition of 40° to 60° C.

* * * * *